US007048357B2

(12) United States Patent
Sato

(10) Patent No.: US 7,048,357 B2
(45) Date of Patent: May 23, 2006

(54) PRINTING USING A PRINT HEAD WITH STAGGERED NOZZLE ARRANGEMENTS

(75) Inventor: Akito Sato, Nagano-ken (JP)

(73) Assignee: Seiko Epson Corporation, Nagano-ken (JP)

( * ) Notice: Subject to any disclaimer, the term of this patent is extended or adjusted under 35 U.S.C. 154(b) by 0 days.

(21) Appl. No.: 11/084,437

(22) Filed: Mar. 17, 2005

(65) Prior Publication Data

US 2005/0162464 A1 Jul. 28, 2005

Related U.S. Application Data

(62) Division of application No. 10/029,233, filed on Dec. 21, 2001, now Pat. No. 6,883,898.

(30) Foreign Application Priority Data

Dec. 27, 2000 (JP) ..... 2000-397089
Dec. 27, 2000 (JP) ..... 2000-397119

(51) Int. Cl.
*B41J 2/145* (2006.01)

(52) U.S. Cl. ..... 347/41; 347/43; 347/15

(58) Field of Classification Search ..... 347/41, 347/15, 43, 12, 40, 16
See application file for complete search history.

(56) References Cited

U.S. PATENT DOCUMENTS 6,030,065 A 2/2000 Fukuhata
6,254,218 B1 7/2001 Suzuki et al.
6,267,468 B1 7/2001 Torgerson et al.
6,325,489 B1 12/2001 Endo
6,474,777 B1 * 11/2002 Fujita et al. ..... 347/41
6,491,373 B1 12/2002 Fujita et al.

FOREIGN PATENT DOCUMENTS

JP 05-185590 A 7/1993
JP 10-278317 A 10/1998
JP 10-309815 A 11/1998
JP 2000-343729 12/2000

OTHER PUBLICATIONS

Notice of Rejection from JPO, 3 page document.
Notice of Rejection from JPO, 2 page document.

* cited by examiner

*Primary Examiner*—Lamson Nguyen
(74) *Attorney, Agent, or Firm*—Beyer, Weaver & Thomas, LLP.

(57) ABSTRACT

Each nozzle array on a print head 28*b* has a plurality of nozzles arranged along sub-scanning direction for discharging a same ink, and at least a pair of nozzle arrays that discharge different inks (a leading nozzle array FN and a trailing nozzle array RN) are arranged in a staggered manner. In an interlace recording using this print head 28*b*, a reference is made to a printing data memory prior to a main scan pass, for a printing data of a plurality of main scan lines that correspond to an overall width in the sub-scanning direction of the staggered nozzle array pair. A single main scan pass is then performed according to the referenced printing data.

12 Claims, 19 Drawing Sheets

INK PASSAGE ARRANGEMENT OF FIRST EMBODIMENT

INK PASSAGE ARRANGEMENT OF COMPARATIVE EXAMPLE ( W28 < W280 )

ACTUAL NOZZLE ARRAYS

EQUIVALENT NOZZLE ARRAY

BI-DIRECTIONAL PRINTING WITH PRINT HEAD OF SECOND EMBODIMENT

BI-DIRECTIONAL PRINTING WITH PRINT HEAD OF COMPARATIVE EXAMPLE

THIRD EMBODIMENT

TRAILING
NOZZLE ARRAY RN

LEADING
NOZZLE ARRAY FN
PASS
RASTER No.
1 2 3 4
L=7
NON-RECORDABLE RANGE
VALID RECORDABLE RANGE
PAPER FEED DIRECTION (SUB-SCANNING DIRECTION)
MAIN SCANNING DIRECTION

TRAILING NOZZLE ARRAY RN
LEADING NOZZLE ARRAY FN
PASS
RASTER No.
1 2 3 4 5
NON-RECORDABLE RANGE
VALID RECORDABLE RANGE
L=1
L=25
PAPER FEED DIRECTION (SUB-SCANNING DIRECTION)
MAIN SCANNING DIRECTION

TRAILING
NOZZLE ARRAY RN
PASS
RASTER No. 1 2 3 4 5
L=3
L=3
L=3
L=7

LEADING
NOZZLE ARRAY FN
PASS
1 2 3 4 5
NON-RECORDABLE RANGE
UPPER END LINE
VALID RECORDABLE RANGE
PAPER FEED DIRECTION (SUB-SCANNING DIRECTION)
MAIN SCANNING DIRECTION
SHIFT TO MIDSECTION PROCESS
:NOT IN USE
SHIFT TO MIDSECTION PROCESS

TRAILING NOZZLE ARRAY RN
LEADING NOZZLE ARRAY FN
PASS
RASTER No.
-1 0 +1 +2 +3
L=7
L=3
L=3
L=3
VALID RECORDABLE RANGE (determined by the leading nozzle array)
LOWER END LINE
PAPER FEED DIRECTION (SUB-SCANNING DIRECTION)
SHIFT TO LOWER END PROCESS
:NOT IN USE
MAIN SCANNING DIRECTION

PRINTING USING A PRINT HEAD WITH STAGGERED NOZZLE ARRANGEMENTS

CROSS-REFERENCE TO RELATED APPLICATION

This application is a divisional of U.S. patent application Ser. No. 10/029,233 filed on Dec. 21, 2001 U.S. Pat. No. 6,883,898 in the name of Akito SATO, and entitled "PRINTING USING A PRINT HEAD WITH STAGGERED NOZZLE ARRANGEMENTS," which is incorporated herein by reference in its entirety and for all purposes.

BACKGROUND OF THE INVENTION

1. Field of the Invention

The present invention relates to a technology for printing an image on a printing medium while performing a main scan.

2. Description of the Related Art

In recent years, color jet printers that discharge ink droplets from a print head are widely used as computer output devices. For the color ink jet printers, various technologies have been developed to meet two requirements, i.e., improvement of image quality and increase of printing speed.

Improvement of image quality can be achieved by increasing the number of ink colors, for example. However, the increase of the number of ink colors will lead to increase of the number of nozzle arrays disposed on a print head, thereby enlarging the size of the print head. As a result, the overall size of the printing device also becomes larger. Accordingly, there has been desired a technique to keep the print head smaller in size even in case the entire nozzle number increases. There has been also desired a technique to perform printing with high speed and high image quality by using such print head.

SUMMARY OF THE INVENTION

Accordingly, an object of the present invention is to provide a technique that can keep the print head smaller in size.

Anther object of the present invention is to provide a technique that can achieve increase of printing speed and improvement of image quality without excessively increasing the size of a print head.

In order to attain at least part of the above and other related objects, there is provided a printing device for printing an image on a printing medium while performing main scanning. The printing device comprises: a print head having a plurality of nozzle arrays. Each of the nozzle arrays has a plurality of nozzles arranged along a sub-scanning direction for discharging a same ink. At least one pair of nozzle arrays for discharging different inks are positioned such that nozzles of the nozzle array pair are arranged in a staggered manner.

In such a printing device, since at least a pair of nozzle arrays are arranged in staggered manner, a spacing between the nozzle array pair can be smaller than that without the staggered arrangement. As a result, the size of the print head can be retained smaller.

In a preferred embodiment, the staggered nozzle array pair consists of a leading nozzle array that reaches a leading edge of the printing medium relatively earlier and a trailing nozzle array that reaches the leading edge relatively later when the sub-scan is performed. The printing is performed according to interlace recording where only a plurality of main scan lines separated one another are recorded by each nozzle array in a single main scan pass, and where recording of successive main scan lines is achieved by a plurality of main scan passes that include at least one sub-scan feed therebetween. In the interlace recording, the printing data memory is referred to prior to a main scan pass, for printing data of a plurality of main scan lines that correspond to an overall width in the sub-scanning direction of the staggered nozzle array pair, and the main scan pass is performed according to the referenced printing data.

These and other objects, features, aspects, and advantages of the present invention will become more apparent from the following detailed description of the preferred embodiments with the accompanying drawings.

DESCRIPTION OF THE PREFERRED EMBODIMENTS

Preferred embodiments of the present invention are described in the following order:

A. First embodiment,

B. Second embodiment,

C. Third embodiment,

D. Examples of print operation, and

E. Modifications.

A. First Embodiment

Figure 1:
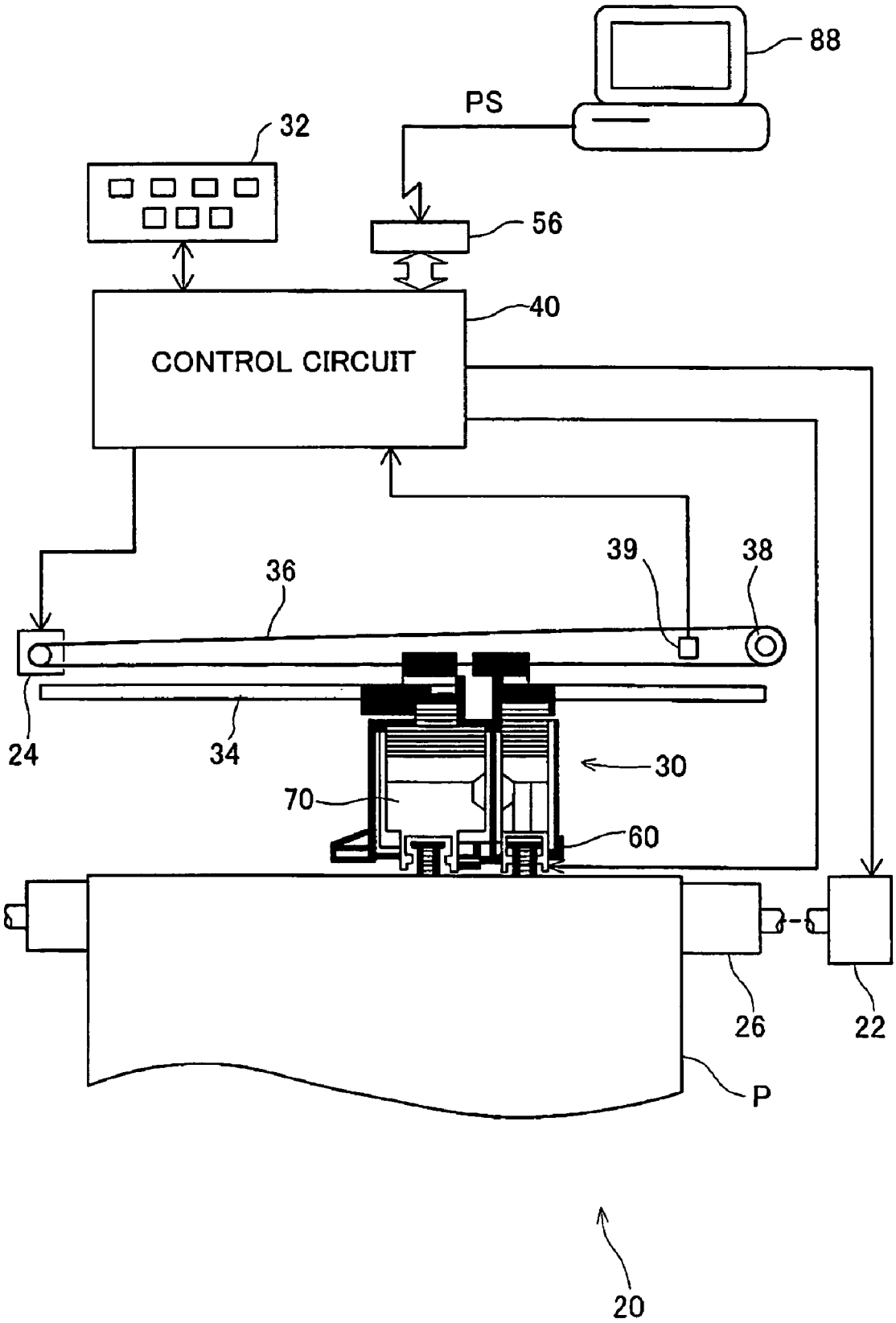
FIG. 1 is a general block diagram of a printing system equipped with an ink jet printer 20 as the first embodiment of the present invention.

FIG. 1 is a schematic diagram of a printing system equipped with an ink jet printer 20 as a first embodiment of the present invention. The printer 20 comprises a sub-scan feed mechanism that advances a printing paper P in a sub-scanning direction by a paper feed motor 22, a main scan feeding mechanism that reciprocates a carriage 30 in an axial direction of a platen 26 (a main scanning direction) by a carriage motor 24, a head driving mechanism that drives a print head unit 60 mounted on the carriage 30 to control ink discharge and dot formation, and a control circuit 40 that administers signal exchanges between the carriage motor 24, the print head unit 60, and an operation panel 32. The control circuit 40 is connected to a computer 88 via a connector 56.

The sub-scan feed mechanism has a gear train (not shown) that transmits rotation of the paper feed motor 22 to the platen 26 and a paper carrier roller (not shown). The main scan feed mechanism has a sliding rail 34, a pulley 38, and a location sensor 39. The sliding rail is installed parallel to the axis of the platen 26 to slidably support the carriage 30. An endless driving belt 36 is extended between the pulley 38 and the carriage motor 24. The location sensor 39 detects an origin location of the carriage 30.

Figure 2:
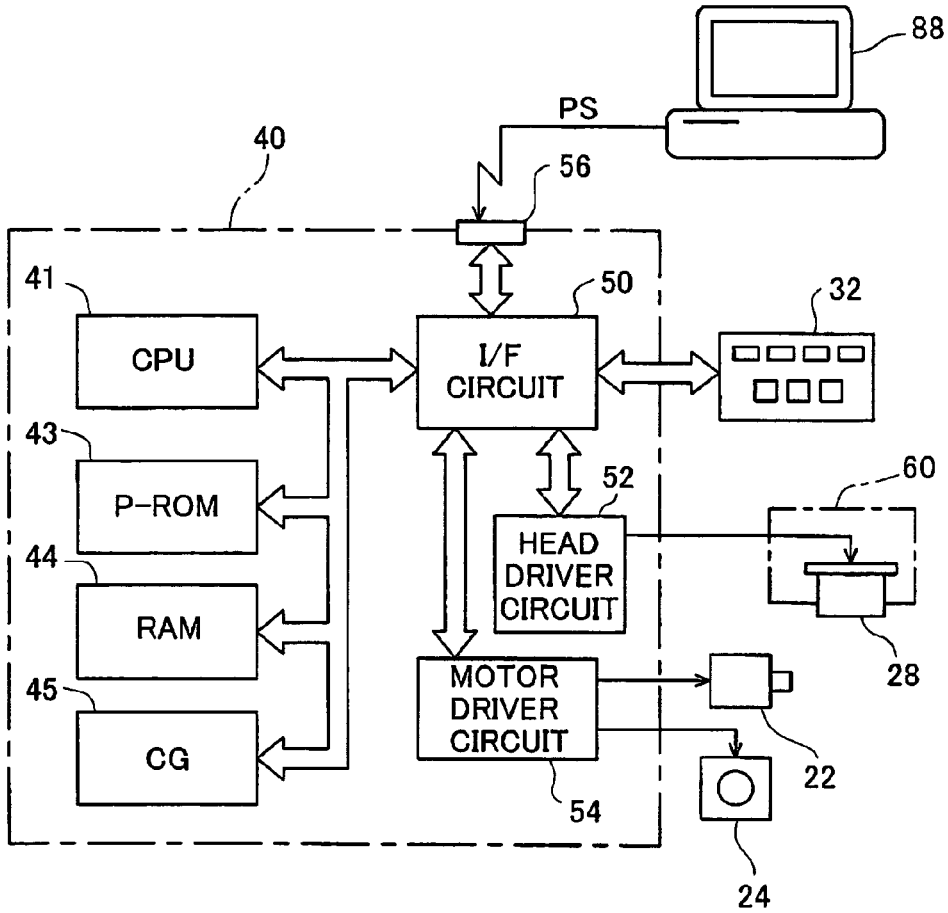
FIG. 2 is a block diagram of the circuit configuration of the printer 20 with a control circuit 40.

FIG. 2 is a block diagram showing the circuit configuration of the printer 20 with the control circuit 40. The control circuit 40 is configured as an arithmetic and logic circuit equipped with a CPU 41, a programmable ROM (PROM) 43, a RAM 44, and a character generator (CG) 45 that stores dot matrix of characters. The control circuit is further equipped with an I/F circuit 50 dedicated for interface with between external circuitry such as a head driving circuit 52, a head driver circuit 52 that drives the print head unit 60 to discharge inks, and a motor driver circuit 54 that drives the paper feed motor 22 and the carriage motor 24. The I/F circuit 50 includes a parallel interface circuit integrated therein, and is capable of receiving print signal PS supplied from the computer 88 via the connector 56. The print head unit 60 is equipped with a print head 28 at the bottom.

Figure 3:
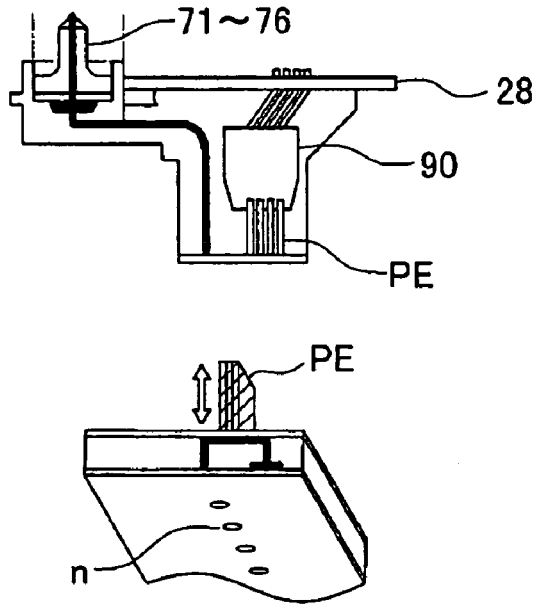
FIG. 3 shows the main part of a print head 28.

FIG. 3 is an explanatory diagram showing the main part of the print head 28. Once an ink cartridge is installed into the print head unit 60, ink is introduced from the cartridge into the print head 28 via conduits 71–76.

The print head 28 has a plurality of nozzles n disposed in arrays for plural ink colors, and an actuator 90 that operates a piezo-electric element PE disposed for each nozzle n. The actuator circuit 90 is a part of the head driver circuit 52 (FIG. 2), and performs on/off controlling of drive signals supplied from a drive signal generation circuit (not shown) in the head driver circuit 52. That is, the actuator circuit 90 latches a data that indicates ON (discharging ink) or OFF (not discharging ink) of each nozzle according to a print signal PS supplied from the computer 88, and applies the drive signal to the piezo-electric element PE only for the ON nozzles.

Figure 4A:
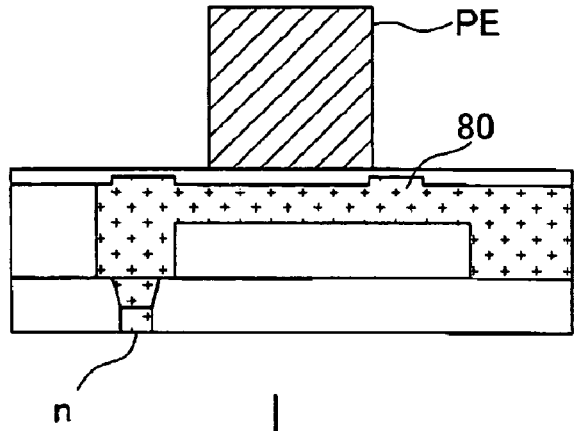
FIGS. 4A and 4B show the driving principle of a nozzle n by a piezo-electric element PE.
Figure 4B:
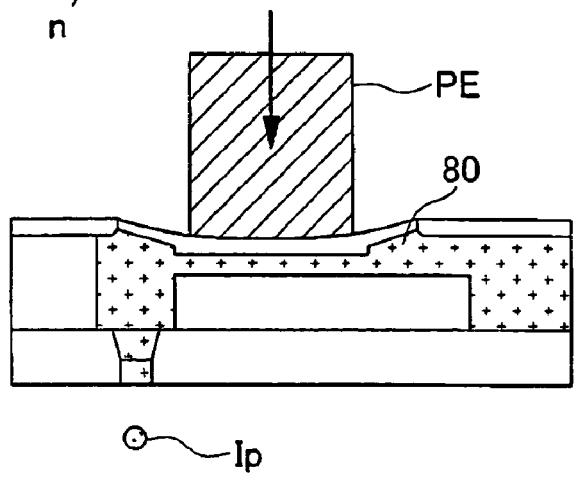

FIGS. 4A and 4B show the driving principle of the nozzle n by the piezo-electric element PE. The piezo-electric element PE is disposed adjacent to an ink passage 80 to the nozzle n. In the present embodiment, when a voltage with a predetermined time width is applied between electrodes disposed on both ends of the piezo-electric element PE, the piezo-electric element PE extends rapidly to deform a side wall of the ink path 80, as shown in FIG. 4B. As a result, volume of the ink path 80 shrinks in response to the extension of the piezo-electric element PE, and an ink particle Ip corresponding to this shrinkage is discharged from the nozzle n with a high speed. Printing is performed with the ink particles Ip infiltrating into paper P on the platen 26.

Figure 5:
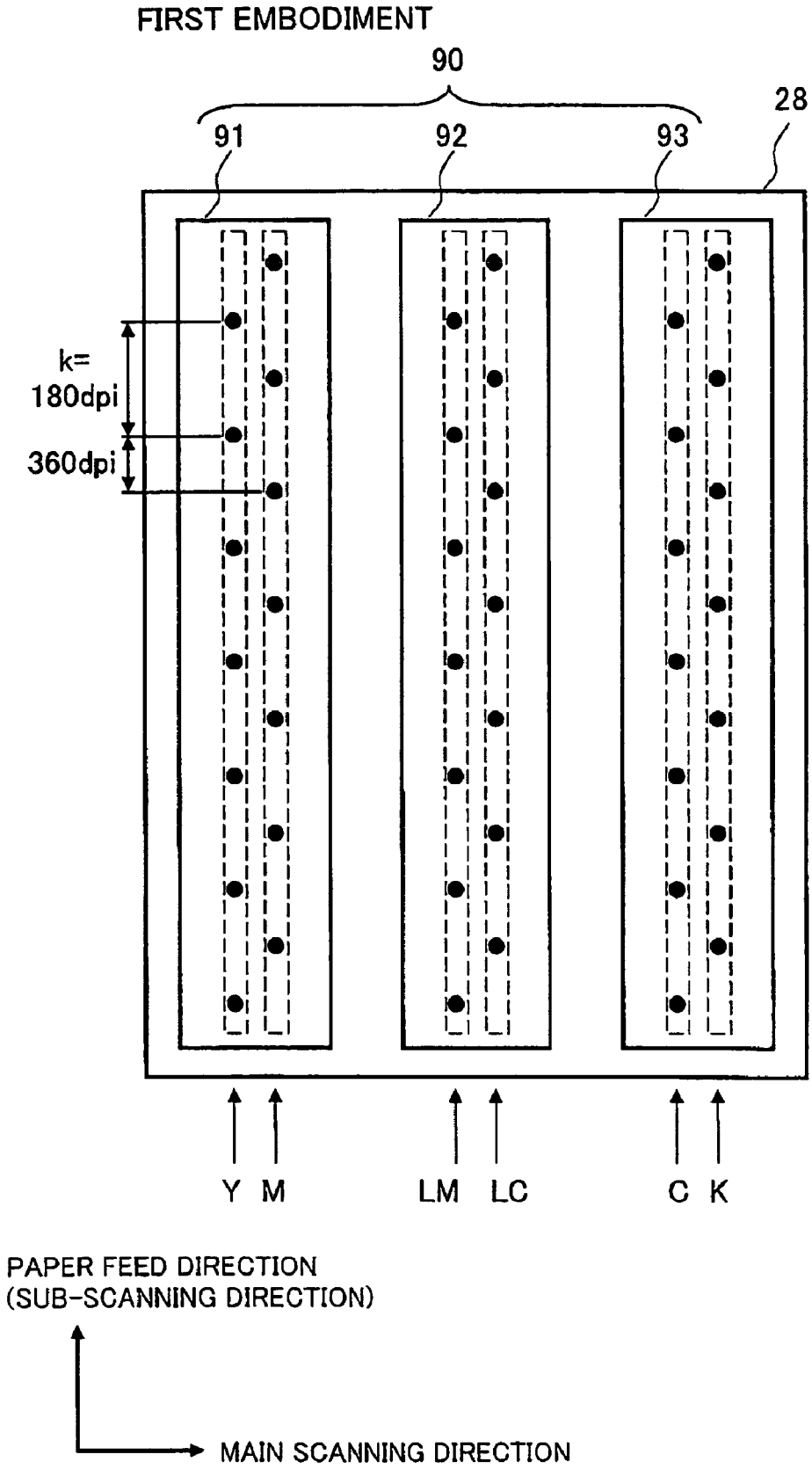
FIG. 5 shows a nozzle array arrangement of the first embodiment.

FIG. 5 shows the arrangement of a plurality of nozzle arrays disposed on the bottom surface of the print head 28. On the print head 28, six nozzle arrays that correspond to six ink colors, i.e., yellow (Y), magenta (M), light magenta (LM), light cyan (LC), cyan (C), and black (K) are disposed in this order along the main scanning direction. In this figure, dashed lines are imaginary lines each enclosing a nozzle array. The cyan and the light cyan are both cyan inks of substantially the same hue but with different concentrations. This is also the case with the magenta and the light magenta.

In this specification, the four inks C, M, Y, and K other than the light inks are referred to as "the four basic color inks". More specifically, the term "the four basic color inks" refers to the cyan ink, the magenta ink, and the yellow ink that can reproduce black color by mixing each ink by substantially equivalent amounts, as well as the black ink which is not gray but fully black. In this specification, four nozzle arrays Y, M, C, and K for discharging these four basic color inks are referred to as "the basic color nozzle arrays."

The actuator circuit 90 includes first to third actuator chips 91–93. The first actuator chip 91 is provided with a yellow nozzle array Y and a magenta nozzle array M. The second actuator chip 92 is provided with a light magenta nozzle array LM and a light cyan nozzle array LC. The third actuator chip 93 is provided with a dark cyan nozzle array C and a black nozzle array K.

Each pair of nozzle arrays on each actuator chip are arranged in a staggered manner or in zigzag. One nozzle array for one color is aligned in the sub-scanning direction, or the paper feed direction, with a constant nozzle pitch k. In this example, the nozzle pitch k is a value corresponding to a printing resolution of 180 dpi (i.e., about 141 μm). Each array of the staggered nozzle array pair is offset by a half of the nozzle pitch k with respect to each other in the sub-scanning direction. Advantages of such staggered arrangements will be discussed in later.

Figure 6:
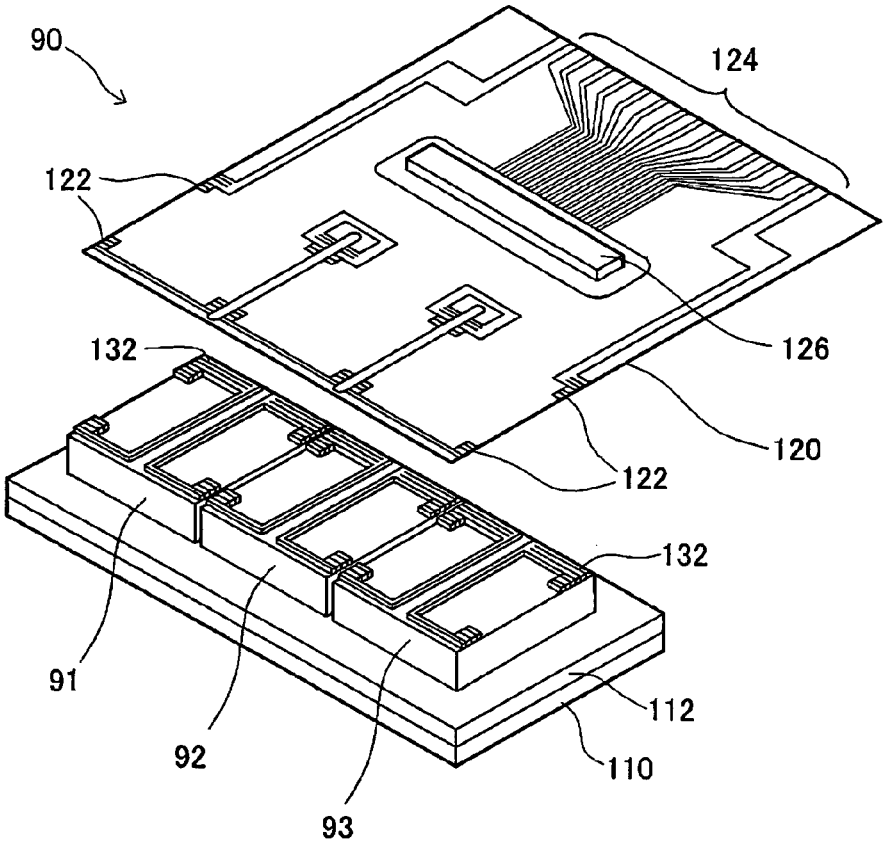
FIG. 6 is an exploded perspective view of an actuator circuit 90.

FIG. 6 is an exploded perspective view of the actuator circuit 90. Three actuator chips 91–93 are bonded with an adhesive on a laminated structure of a nozzle plate 110 and a reservoir plate 112. A connection terminal plate 120 is fixed on the actuator chips 91–93. One end of the connection terminal plate 120 is provided with external connection terminals 124 for electric connection with an external circuit, more specifically, the I/F circuit 50 in FIG. 2. The connection terminal plate 120 is further provided at its bottom surface with internal connection terminals 112 for electric connection with the actuator chips 91–93. A driver IC 126 is disposed on the connection terminal plate 120. The driver IC 126 includes various devices such as a circuit that latches print signals supplied from the computer 88, and an analog switch that on-off controls drive signals in response to the print signals. Wirings between the driver IC 126 and the connection terminals 122, 124 are not shown in the figure.

Figure 7:
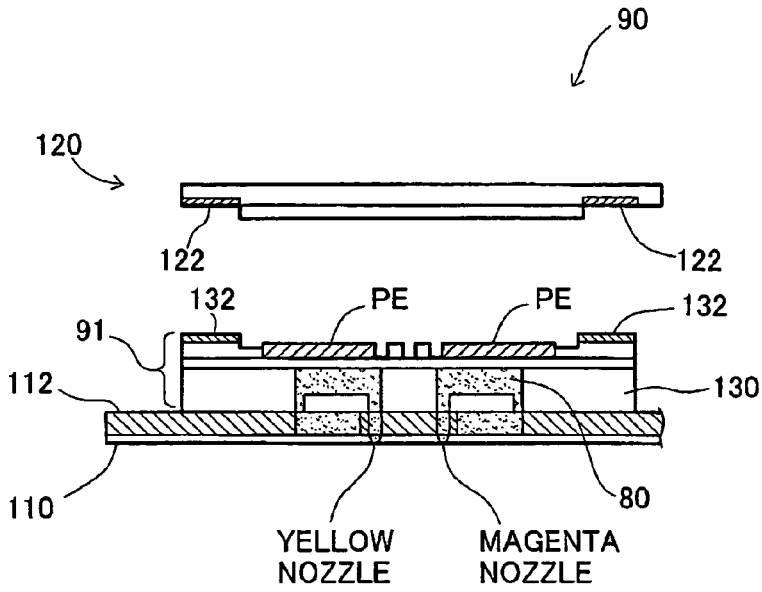
FIG. 7 is a sectional view of the actuator circuit 90.

FIG. 7 is a partial sectional view of the actuator circuit 90. In this sectional view, only the first actuator chip 91 and the connection terminal plate 120 thereon are shown. The second and the third actuator chip 92, 93 also have the same configuration as the first actuator chip 92.

Nozzle outlets for each ink are formed in the nozzle plate 110. The reservoir plate 112 is a tabular structure forming an ink reservoir. The actuator chip 91 has a ceramic sintered body 130 that forms the ink passages 80 (FIG. 4), piezo-electric elements PE arranged thereon via a wall surface, and terminal electrodes 132. When the connection terminal plate 120 is fixed on the actuator chip 91, the connection terminals 122 disposed on the bottom surface of the connection terminal plate 120 and the terminal electrodes 132 disposed on the top surface of the actuator chip 91 are electrically connected. Wirings between the terminal electrodes 132 and the piezo-electric elements PE are not shown in the figure.

As can be appreciated from the above description, each pair of nozzle arrays on one actuator chip 91 are manufactured as one piece at a time, by bonding the nozzle plate 110, the reservoir plate 112, and the ceramic sintered body 130 all together. Accordingly, the positional relationship of each nozzle array pair can be more precise than that obtained by arranging each nozzle array of the pair on different actuator chips respectively. The ceramic sintered body 130 organizes the ink passages 80 for a pair of nozzle arrays, and can be referred to as "an ink passage structure".

Figure 8:
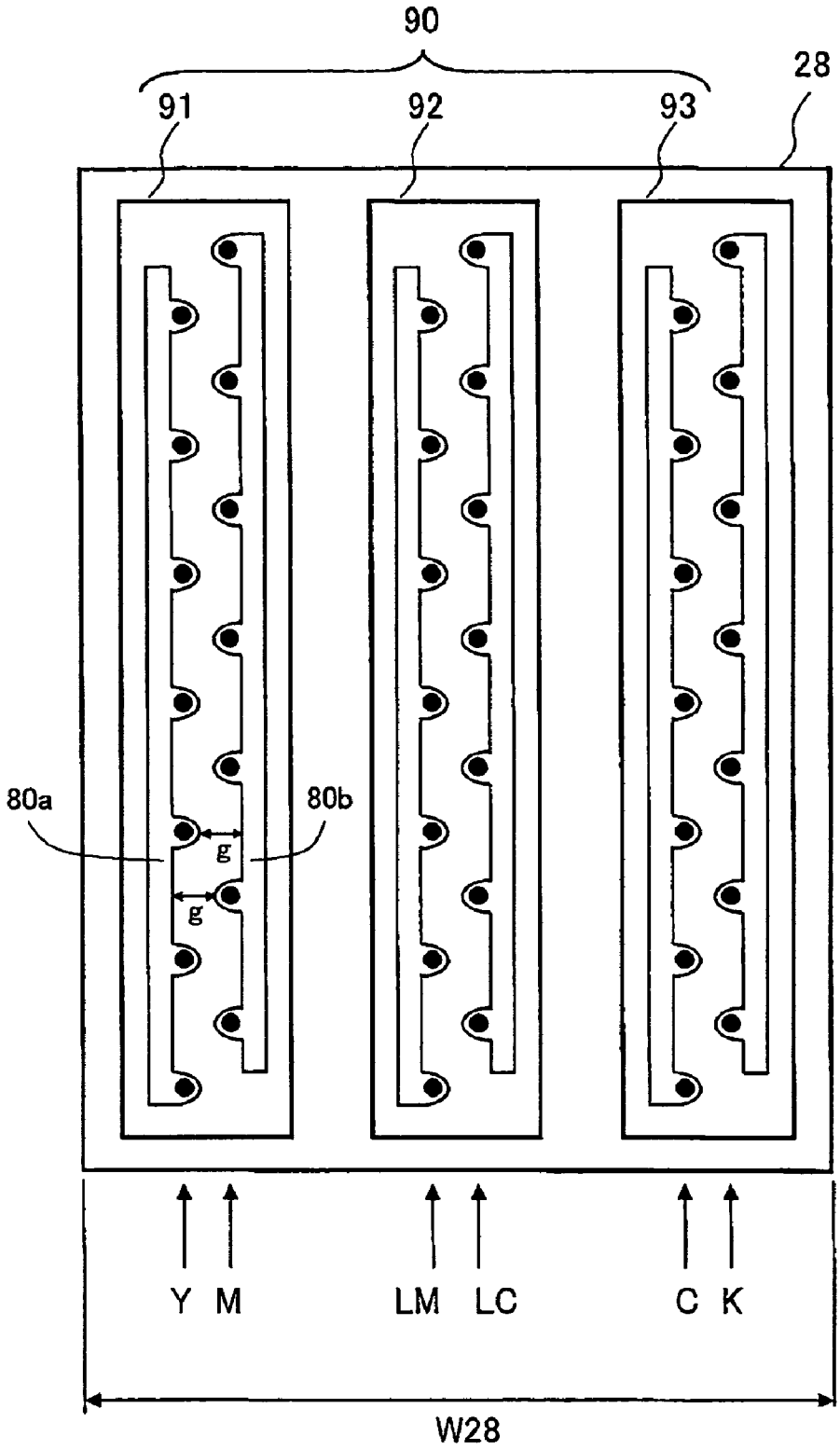
FIG. 8 shows ink passage arrangement in the print head 28 of the first embodiment.

FIG. 8 shows the arrangement of the ink passages in the print head 28 of the first embodiment. The first actuator 91 is provided with an ink passage 80*a* for a yellow nozzle array Y and another ink passage 80*b* for a magenta nozzle array M. This also applies to the other actuators 92, 93. Each pair of ink passages 80*a*, 80*b* are formed such that their passage portions proximate to the nozzles are protruding toward the opposite passage. That is, the ink passage 80*a* for the yellow nozzle array is formed to have its ink passage portions proximate to the nozzles protruding towards the magenta nozzle array. Similarly, the ink passage 80*b* for the magenta nozzle array is formed to have its ink passage portions proximate to the nozzles protruding towards the yellow nozzle array Such a pair of ink passages 80*a*, 80*b* are formed in the ceramic sintered body 130 (FIG. 7).

In other words, the two ink passages 80*a*, 80*b* in one actuator chip are formed to be facing towards one another. However, since the nozzle arrays are arranged in a staggered manner, a gap g between the ink passages is attained sufficiently large (FIG. 8). The gap g needs to be larger than a certain value in order to meet the strength of actuator chip or the requirements in manufacturing. The required value of this gap g can be advantageously satisfied by arranging the pair of nozzle arrays in a staggered manner.

However, if the same ink is discharged from a pair of nozzle arrays, it may be preferable to make the gap g narrower so as to couple the ink passages 80*a*, 80*b* together. On the contrary, the ink passages 80*a*, 80*b* need to be isolated one another if each nozzle array of the pair discharges different inks. It is accordingly preferable to ensure a sufficiently large value for the gap g.

Figure 9:
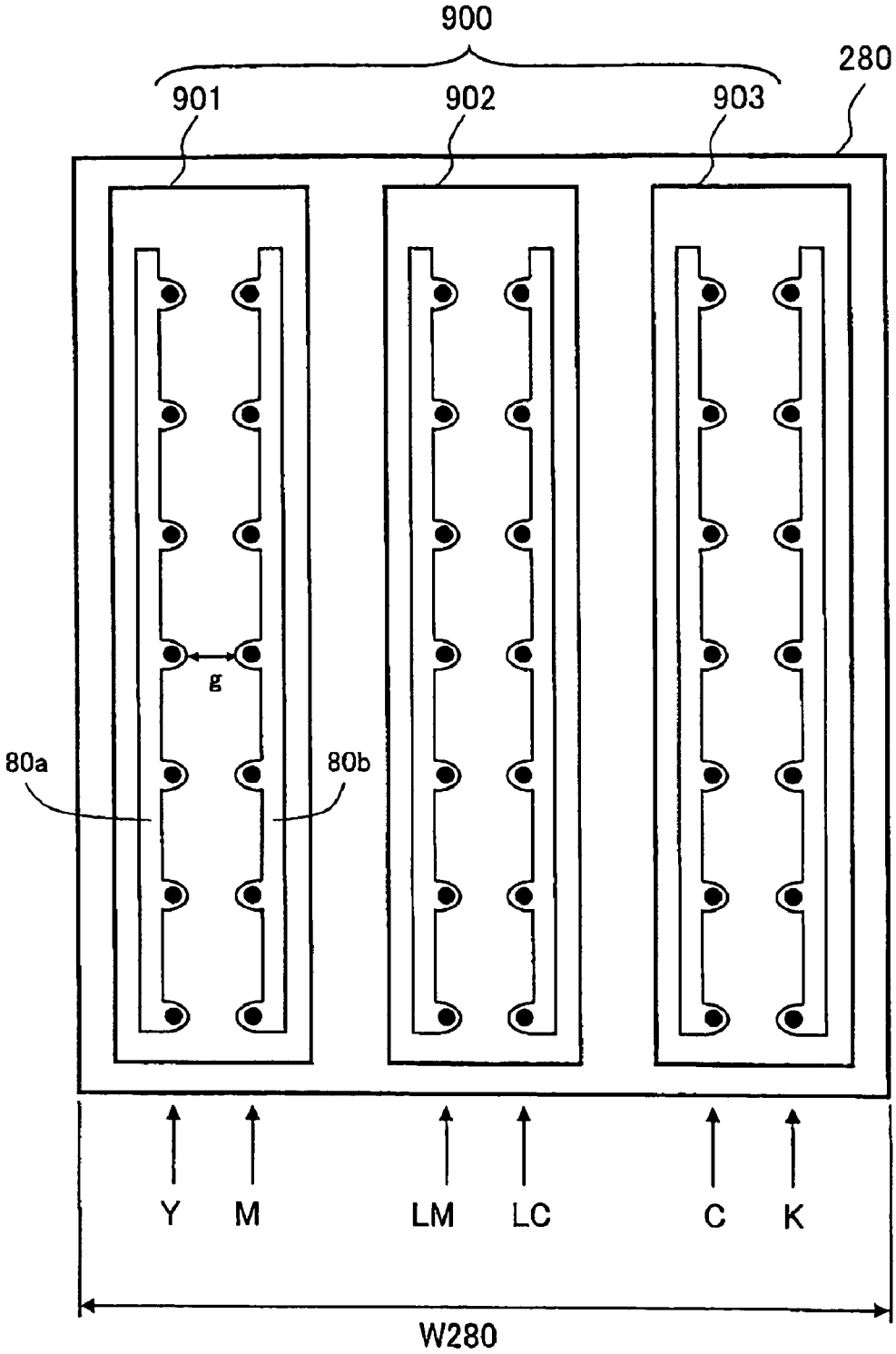
FIG. 9 shows the ink passage arrangement in a print head 280 of a comparative example.

FIG. 9 shows the arrangement of ink passages in a print head 280 of a comparative example. This print head 280 has three actuator chips 901–903, each having a pair of nozzle arrays. This comparative example is different from the first embodiment shown in FIG. 8, in that each pair of nozzle arrays on each actuator chip are not arranged in a staggered manner but are arranged in the same sub-scanning position.

As for the print head 280 of the comparative example, since each pair of nozzle arrays are arranged in a non-staggered manner, a distance between the nozzle arrays needs to be larger than that in the first embodiment shown in FIG. 8, so as to assure the gap g between the ink passages larger than a certain value. Thus, a width W280 in main scanning direction of the print head 280 in the comparative example is much larger than a width W28 of the print head 28 in the first embodiment shown in FIG. 8.

As can be appreciated from the description above, each nozzle array pair are arranged in staggered manner in the first embodiment, so that the spacing between the nozzle arrays of each pair can be narrower than that in the comparative example. As a result, the width of the print head 28 in the main scanning direction can be reduced. Such an advantage would be more significant as the number of nozzle arrays increases.

B. Second Embodiment

Figure 10:
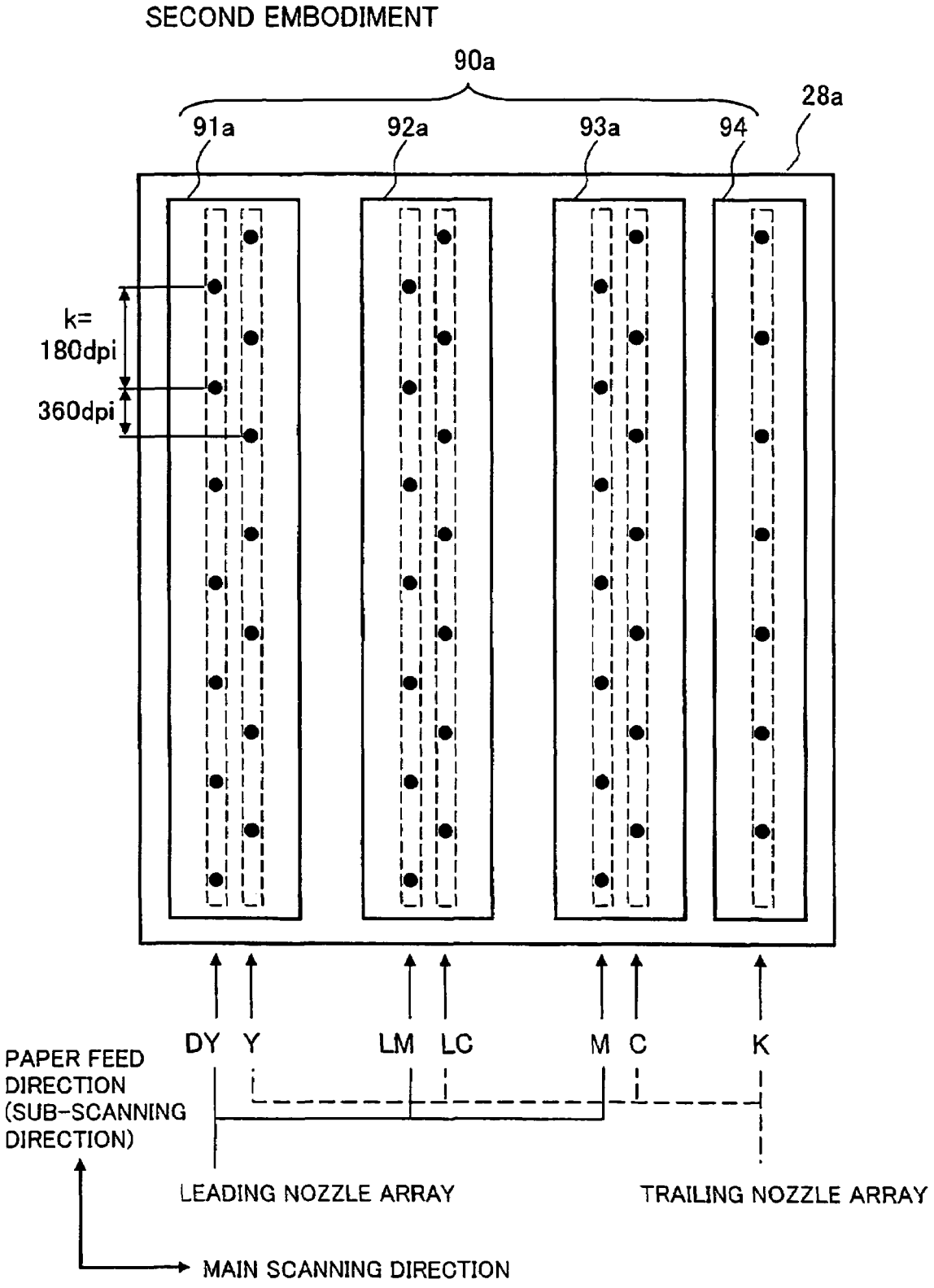
FIG. 10 shows the nozzle array arrangement of the second embodiment.

FIG. 10 illustrates the arrangement of a plurality of nozzle arrays disposed on a bottom surface of a print head in the second embodiment of the present invention. Four actuator chips 91*a*, 92*a*, 93*a*, 94 are disposed on this print head 28*a*. Similar to the first embodiment shown in FIG. 5, each of the first three actuator chips 91*a*, 92*a*, 93*a* has two nozzle arrays arranged in a staggered manner. The fourth actuator chip 94 has only one nozzle array.

The first actuator chip 91*a* is provided with a dark yellow nozzle array DY and a yellow nozzle array Y. The second actuator chip 92*a* is provided with a light magenta nozzle array LM and a light cyan nozzle array LC. The third actuator chip 93*a* is provided with a magenta nozzle array M and a cyan nozzle array C. The fourth actuator chip 94 has a black nozzle K only.

The dark yellow (DY) includes a yellow colorant and colorants of other colors, for example, cyan and magenta. By using the dark yellow ink containing cyan and magenta colorants, the amount of ink discharged onto a printing medium (particularly the amount of the solvent) can be advantageously reduced when compared with a case of discharging ink droplets of yellow, cyan, and magenta separately.

As for the three nozzle arrays DY, LM, and M, the nozzles on their front ends reach the edge of a printing paper earlier than the other nozzle arrays Y, LC, C, and K. Thus, the nozzle arrays DY, LM, and M whose end nozzles reach the edge of a printing paper earlier are hereinafter referred to as "the leading nozzle arrays." The nozzle arrays Y, LC, C, and K whose end nozzles reach the edge of a printing paper later are referred to as "the trailing nozzle arrays."

The print head 28*a* of the second embodiment has three pairs of nozzle arrays arranged in a staggered manner, too. Accordingly, the width of the print head in the main scanning direction can be advantageously reduced.

The light cyan nozzle array LC and the light magenta nozzle array LM are arranged in a staggered manner and has an advantage as follows. That is, since the light cyan ink and the light magenta ink are discharged onto different main scanning lines in a single main scan pass, the time interval between the deposition of the two inks at the same pixel position is longer than that in the comparative example (FIG. 9). As a result, the previously discharged ink will be easy to dry, and the color reproduction can be stabilized. The staggered arrangement of the light ink nozzle arrays LC, LM also has the following advantages.

Figure 11A:
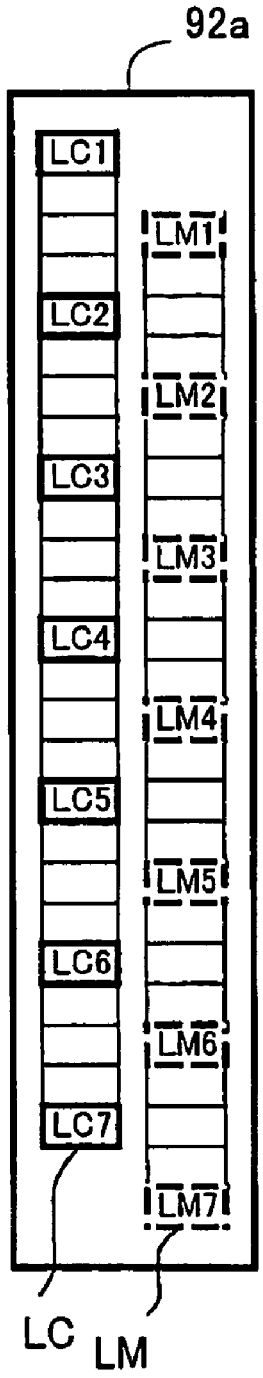
FIGS. 11A and 11B show actual nozzle arrays LC, LM in the second embodiment and their equivalent nozzle array.
Figure 11B:
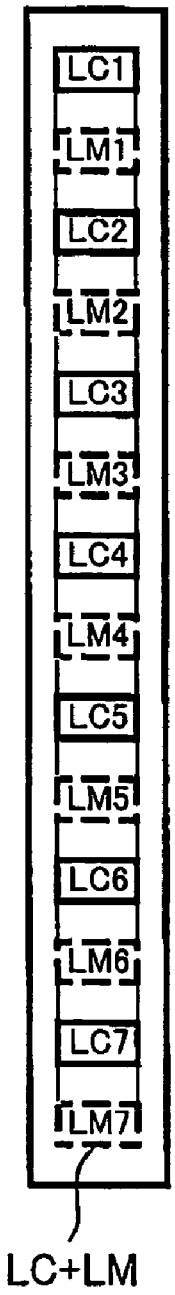

FIG. 11A illustrates a pair of nozzle arrays LC, LM arranged in a staggered manner, and FIG. 11B illustrates a nozzle array equivalent to the pair. A pair of nozzle arrays disposed in the actuator chip 92*a* is comprised of a light cyan nozzle array LC and a light magenta nozzle array LM. The light cyan nozzle array LC has seven nozzles LC1–LC7. The light magenta nozzle array LM also has seven nozzles LM1–LM7. Numerals 1–7 succeeding the symbols LC, LM for each nozzle array indicate the ordinal number of each nozzle when counting from the trailing edge of the print head. That is, the nozzles LC1, LM1 are the nozzles at the most trailing edge, and the nozzles LC7, LM7 are the nozzles at the most leading edge.

The equivalent nozzle array shown in FIG. 11B represents a nozzle array that is capable of recording the same number of main scan lines as those recorded by a pair of nozzle arrays LC, LM in a single main scan pass. In other words, the printing performed by a pair of nozzle arrays LC, LM is substantially equivalent to the printing performed by this one equivalent nozzle array.

Figure 12:
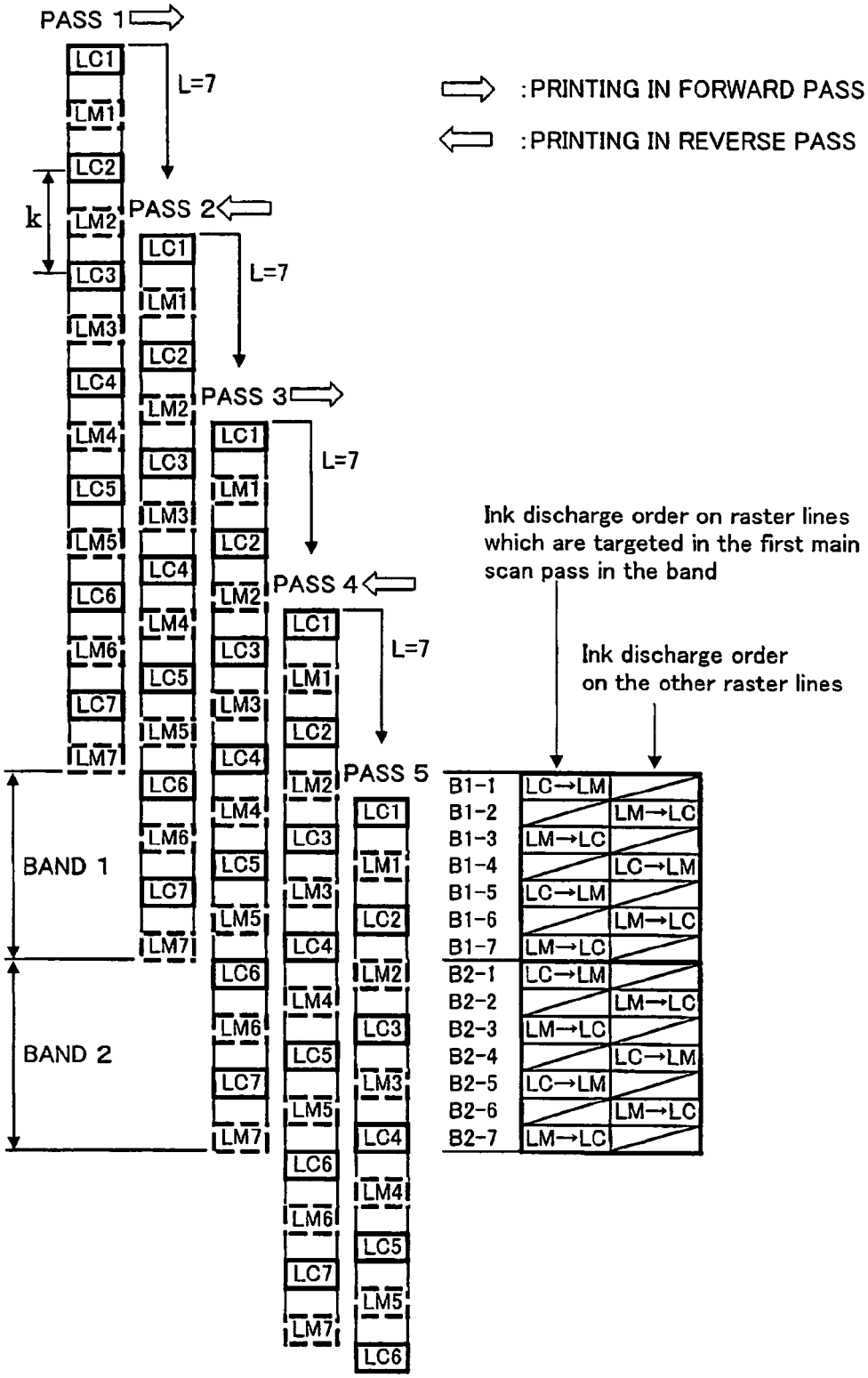
FIG. 12 shows an example of bi-directional printing using the print head of the second embodiment.

FIG. 12 is an explanatory drawing illustrating, with the equivalent nozzle array, an example of bi-directional printing using the print head 28*a* of the second embodiment. The term "pass 1", "pass 2" written on top of each equivalent nozzle array indicates the ordinal number of its main scan pass. That is, the "pass 1" is a first main scan pass and the "pass 2" is a second main scan pass. In the recording mode shown in FIG. 12, a sub-scan feed of a constant amount L (=7 dots) is performed each time a single main scan pass is performed. The unit "dot" of the sub-scan feed amount represents a dot pitch that corresponds to a printing resolution in the sub-scanning direction (i.e., a main scan line pitch). The nozzle pitch k within a single nozzle array is 180 dpi, which corresponds to four main scan lines (also referred to as raster lines). Accordingly, in the example of FIG. 12, the printing resolution in the sub-scanning direction is 720 dpi.

Blank arrows on the right side of each pass number indicate the printing direction, that is, either a forward or reverse direction. That is, for an odd numbered pass the printing is performed in the forward direction, and for an even numbered pass the printing is performed in the reverse direction.

On the lower right hand side of FIG. 12, ink discharging orders in each main scan line of each band are indicated. The term "band" refers to a region, a frontier print region, where ink is discharged for the first time from some leading nozzles of the nozzle array in a single main scan pass after one sub-scan feed. The reference symbol "B1-1" indicates a first main scan line in band 1 and "B1-2" indicates a second main scan line in the band 1. Similarly, "B2-1" indicates a first main scan line in band 2.

There are two columns shown on the right side of each main scan line of each band. The first columns indicates in which order the light inks LC, LM are discharged on the main scan line that is targeted for recording in the first main scan pass for each band. For example, four main scan lines B1-1, B1-3, B1-5, and B1-7 are targeted for recording in the first main scan pass (i.e., pass 2) performed for the band 1. Among them, two main scan lines B1-1, B1-5 are discharged with light cyan ink LC first and then with light magenta link LM next in a later pass (in pass 4 specifically). On the other hand, the other two main scan lines B1-3, B1-7 are discharged with light magenta link LM first and then with light cyan ink LC next in the later pass 4. The second columns indicates in which order the light inks LC, LM are discharged on the main scan line that is not targeted for recording in the first main scan pass for each band.

Such discharging orders are common in the band 1 and the band 2. In other words, it is appreciated that in the example shown in FIG. 12, the ink discharging orders are kept in a certain order in each band, or a frontier print region.

Figure 13:
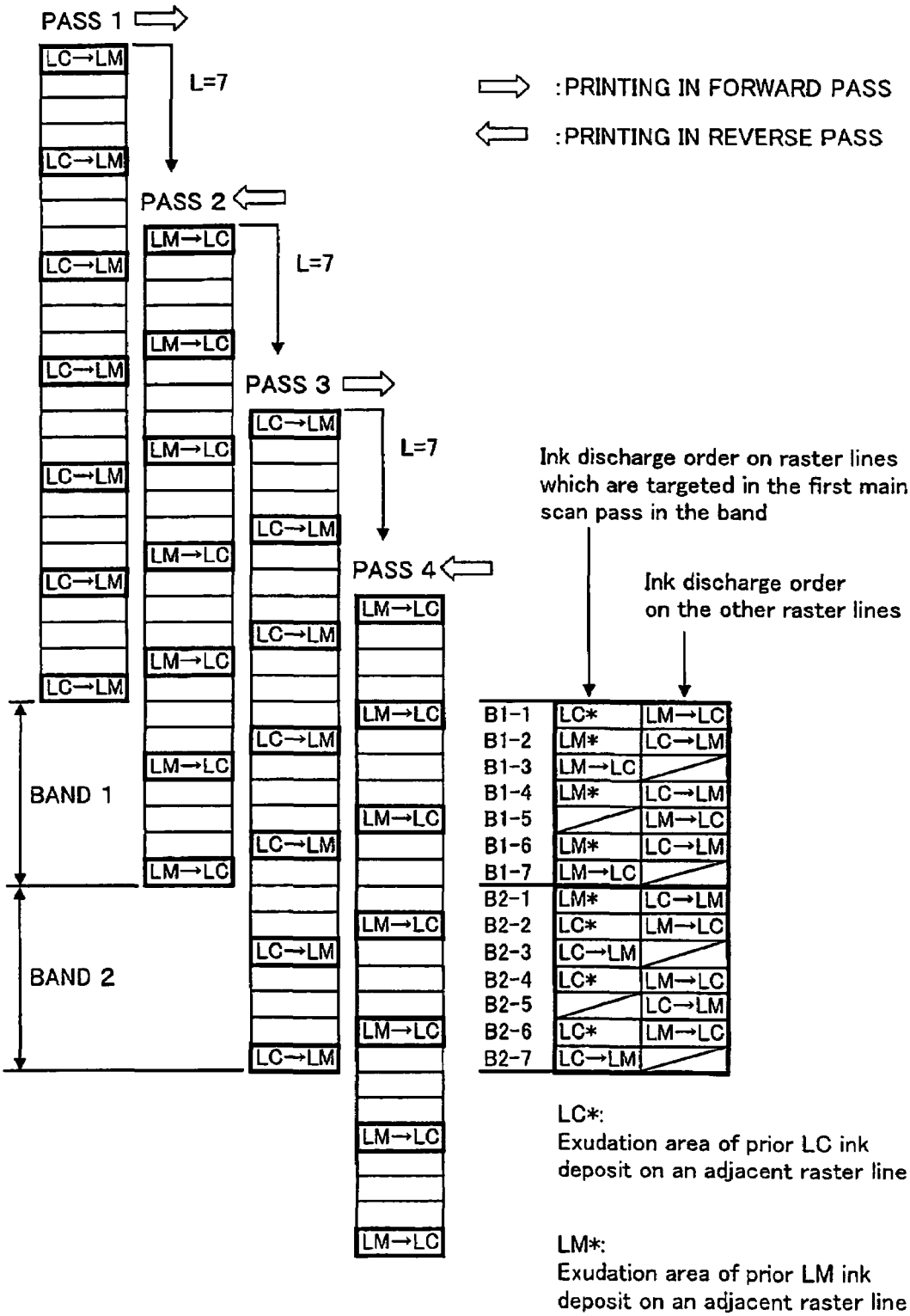
FIG. 13 shows an example of bi-directional printing using the print head of the comparative example.

FIG. 13 illustrates an example of bi-directional printing using the print head 280 of the comparative example shown in FIG. 9. The sub-scan feed amount L is the same as that shown in FIG. 12. Similar to FIG. 12, ink discharging orders on each main scan line of each band are also indicated on the lower right hand side of FIG. 13. However, the symbol "LC*" in the first column implies that the indicated main scan line has an adjacent main scan line on which light cyan inks LC is discharged prior to light magenta inks LM and that the indicated line is therefore affected by exudation of the light cyan ink LC on the adjacent line. Similarly, the symbol "LM*" implies that the corresponding scan line is affected by exudation of light magenta ink LM that is previously discharged on its adjacent main scan line.

The term "affection of ink exudation" represents a phenomenon as follows. In a normal ink jet printer, a line width recorded by a single scan pass is wider than a theoretical value determined by its printing resolution. This results in overlap of adjacent lines, thereby preventing generation of white stripes in filled out areas which may be generated because of print head characteristics and sub-scan feed precision of printing medium. Additionally, in color printing, color reproduction (visual color) depends on ink discharging orders and discharging interval of different inks (i.e., drying time of previously discharged ink). Particularly, the first ink discharged onto a region with no ink previously discharged tends to have great influence on colors of adjacent main scan lines.

In the band 1 of FIG. 13, light magenta ink LM first discharged onto the main scan lines B1-3, B1-7 possibly oozes into its surrounding areas and may have great influence on colors of adjacent main scan lines. In the band 2, light cyan ink LC first discharged onto the main scan lines B2-3, B2-7 possibly oozes into its surrounding areas and may have great influence on colors of adjacent main scan lines. As a result, visual colors (i.e., color reproduction) of the band 1 and the band 2 would be significantly different.

On the other hand, since the ink discharging orders of each band are kept in a certain order in the example of FIG. 12, influence of ink exudation does not vary for every band as in the case of FIG. 13. That is, the color reproduction in each band (frontier print region) can be stabilized by arranging the light ink nozzles arrays LC, LM in a staggered manner. This advantageously results in the improvement of image quality.

Sub-scan feed with a constant feed amount L (referred to as "constant feeding") has been employed in the example of FIG. 12, but it is also possible to employ sub-scan feed that uses a plurality of different feed amounts (referred to as "anomalous feeding"). However, the effects described above with reference to FIG. 12 and FIG. 13 are particularly significant when the sub-scan feed amount L is constant.

The above advantages obtained by the staggered arrangement of the light ink nozzle arrays LC, LM can also be achieved by the staggered arrangement of the ink nozzle arrays C, M. In image regions with relatively low image density, or light regions, the light inks are discharged in great amounts, and the advantages obtained by the staggered arrangement of light inks will be greater. Furthermore, in image regions with relatively high image density, or dark regions, dark inks are discharged in great amounts, and the advantages obtained by the staggered arrangement of dark inks will be greater.

The above-mentioned advantages regarding the staggered arrangements can also be achieved by other arrangements. For example, even in a case that the light cyan nozzle array LC and the light magenta nozzle array LM are not adjacent with each other, it is possible to obtain similar effects as long as these nozzle arrays LC, LM are disposed to have the same positional relationship as that of a nozzle array pair arranged in a staggered manner with respect to positions in the sub-scanning direction.

C. Third Embodiment

Figure 14:
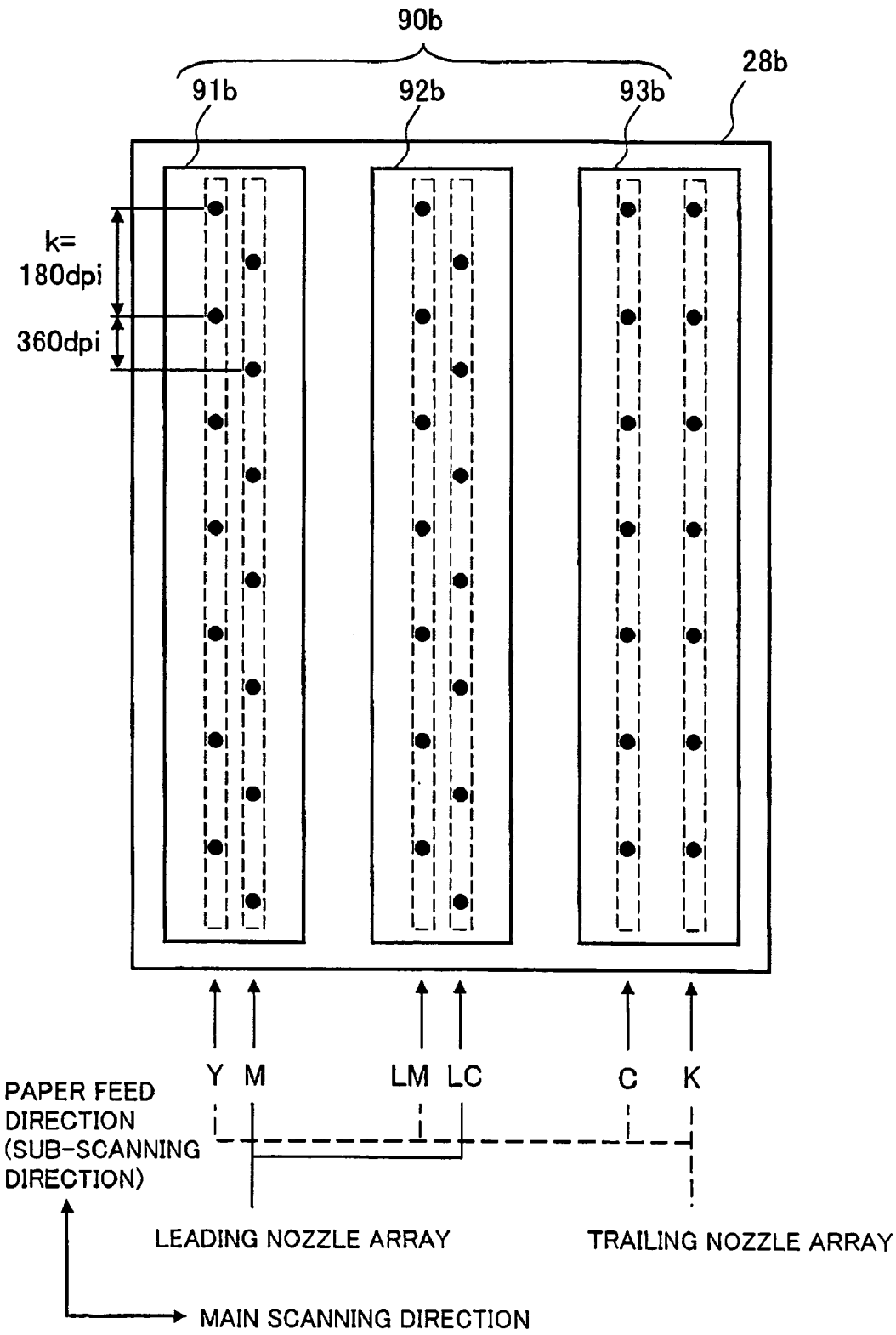
FIG. 14 shows the nozzle array arrangement of the third embodiment.

FIG. 14 illustrates the arrangement of a plurality of nozzle arrays disposed on a bottom surface of a print head in a third embodiment of the present invention. Three actuator chips 91*b*, 92*b*, 93*b* are disposed on this print head 28*b*. The first two actuator chips 91*b*, 92*b* are similar to those in the first embodiment shown in FIG. 5, but are different in that the leading nozzle arrays and the trailing nozzle arrays are reversed one another. That is, as for the actuator chips 91*b*, 92*b* in the third embodiment, a magenta nozzle array M and a light cyan nozzle array LC are the leading nozzle arrays, and a yellow nozzle array Y and a light magenta nozzle array LM are the trailing nozzle arrays. As for the third actuator chip 93*b*, a cyan nozzle array C and a black nozzle array K are not arranged in staggered manner but disposed on the same position in sub-scanning direction. The cyan nozzle array C and the black nozzle array K are also the trailing nozzle arrays.

Similar to the second embodiment, the light ink nozzle arrays LC, LM of the print head 28*b* of the third embodiment are also arranged in a staggered manner. Furthermore, the cyan nozzle array C and the magenta nozzle array M are not arranged in a staggered manner and their positions are offset with each other in the sub-scanning direction. Accordingly, image quality can be advantageously improved as in the second embodiment.

The width of the print head 28*b* in the main scanning direction is slightly larger than that of the print head 28 in the first embodiment, but is significantly smaller than that of the print head 280 of the comparative example shown in FIG. 9. Accordingly, in this third embodiment, the width in the main scanning direction can also be retained smaller than that of the conventional print head.

As can be appreciated from the second and third embodiments described above, the present invention does not necessarily configure all the nozzle arrays in the print head in the staggered arrangements, but only needs to configure at least one pair of nozzle arrays that discharges different inks in the staggered arrangement. However, the width of the print head in the main scanning direction gets smaller as the zigzag nozzle array pair increase in number. It is therefore appreciated that more than a half of the nozzle arrays are preferably configured in the staggered arrangements. Furthermore, it is most preferable to arrange as many nozzle arrays as possible in a staggered manner, so that there is none or only one of the nozzle arrays which is not configured in the staggered arrangement.

D. Examples of Print Operation

Figure 15:
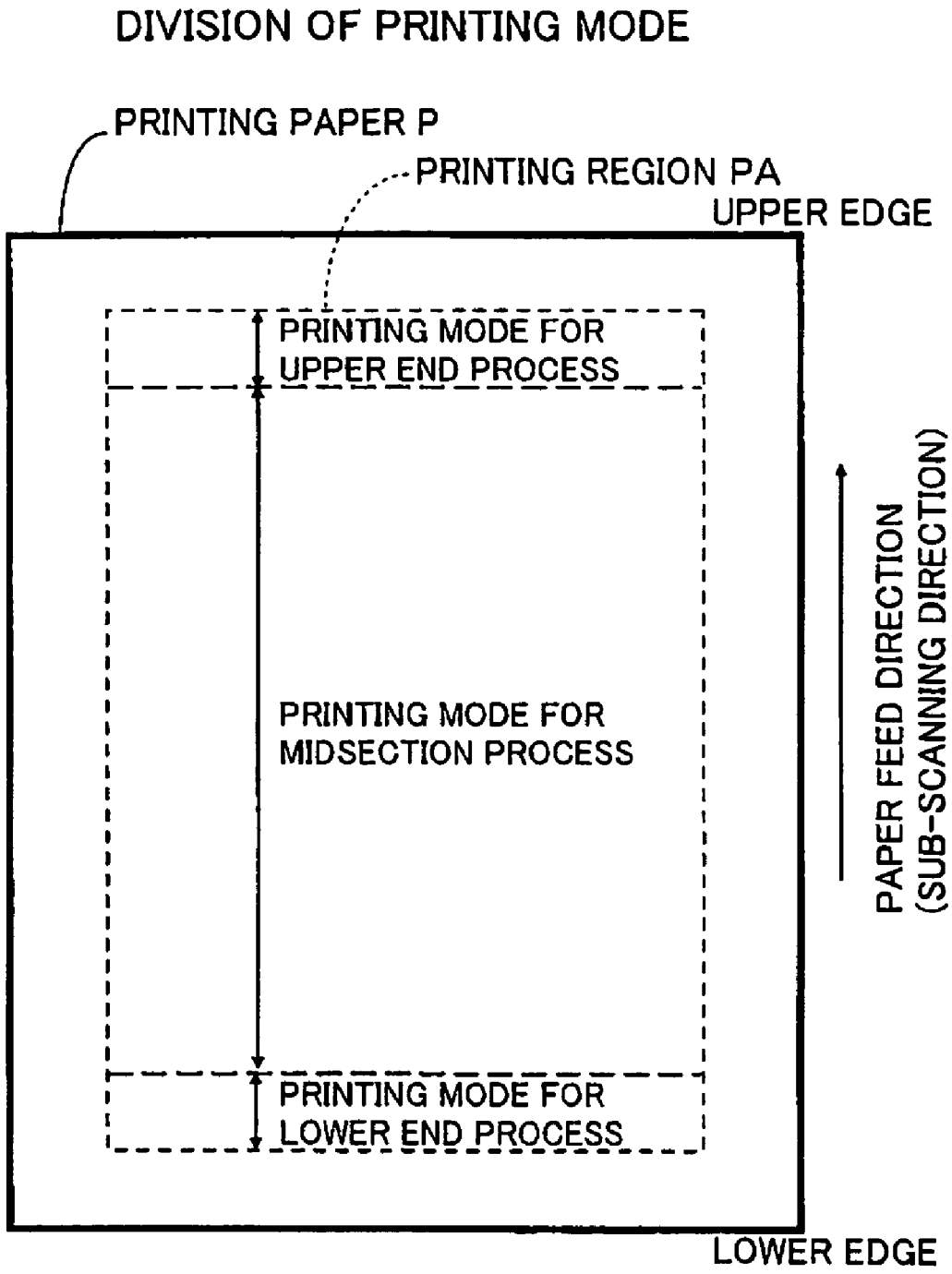
FIG. 15 shows division of a printing paper in terms of recording modes applied.

FIG. 15 shows division of a printing paper in terms of recording modes applied. On the print paper P, a printing region PA is set where the actual printing is to be performed. On a midsection of the printing region, a recording mode with a relatively large sub-scan feed amount is applied. On the other hand, recording modes with relatively small sub-scan feed amounts are applied to the upper and lower ends of the printing region PA respectively. The term "recording mode" and "printing method" is synonymous herein.

In this specification, the printing process in the upper end of the printing paper is referred to as "upper end process", and the printing process in the lower end of the printing paper is referred to as "lower end process." The printing process for a section between these areas is referred to as "midsection process." The upper end process and the lower end process uses a sub-scan feed amount smaller than that of recording mode the midsection process so that the printing region PA is broaden. This feature is further discussed in later. In case of performing rimless printing without margins, the printing region PA is set to be broader than the printing paper P.

In the following description, a recording mode for the midsection process is described first and then recording modes for the upper end process and the lower end process are described next.

Figure 16:
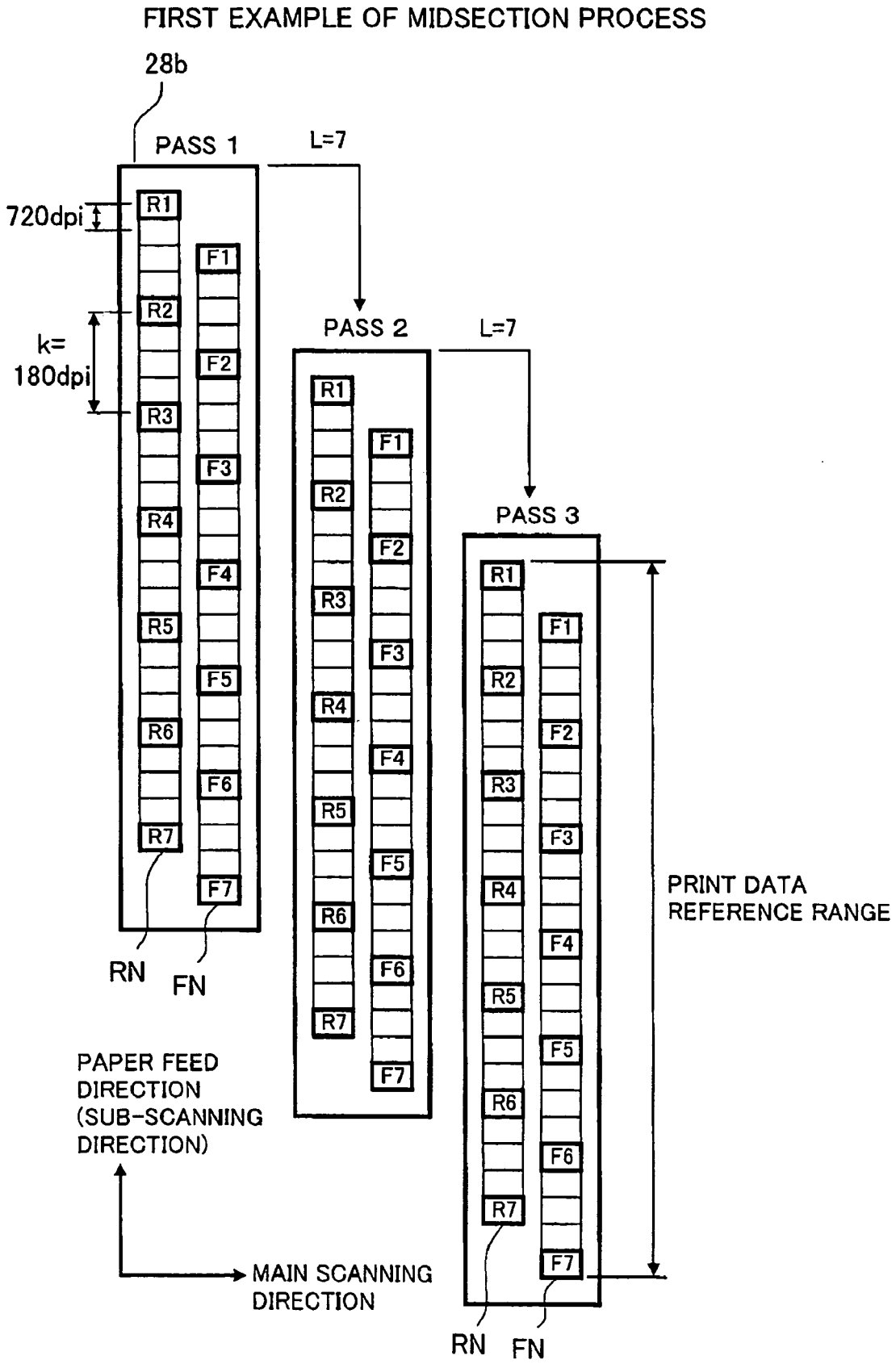
FIG. 16 shows a first example of a recording mode for midsection.

FIG. 16 shows a first example of the recording mode for the midsection. This figure shows a sub-scanning progress of a nozzle array pair (Y and LM for example) on the print head 28*b* of the third embodiment shown in FIG. 14. This nozzle array pair is comprised of a leading nozzle array FN (or front-side nozzle array) and a trailing nozzle array RN (or rear-side nozzle array). The leading nozzle array FN has seven nozzles F1–F7. The trailing nozzle array RN also has seven nozzle arrays R1–R7. The character F or R on each nozzle indicates that the nozzle array is a leading nozzle array FN or a trailing nozzle array RN, and the numerals 1–7 succeeding the characters indicate the ordinal number of each nozzle when counting from the trailing edge of the print head 28*b*.

Although the print head 28*b* shown in FIG. 14 is used in various recording modes described in the following, these recording modes are also applicable to the other print heads other.

In the recording mode shown in FIG. 16, a sub-scan feed of an constant feed amount L (=7 dots) is performed upon completion of every single main scan pass. Nozzle pitch k within a single nozzle array is 180 dpi, which corresponds to four main scan lines (raster lines).

As shown in the right hand side of FIG. 16, when a single main scan pass is performed, the CPU (FIG. 2) makes reference to printing data stored in the RAM 44 for a plurality of main scan lines which correspond to the overall width of the leading nozzle array FN and the trailing nozzle array RN in the sub-scanning direction. The CPU 41 then performs a single main scan pass in response to the printing data for the nozzle positions of these nozzle arrays FN, RN. In this way, since a reference is made for a printing data of a plurality of main scan lines that correspond to the overall width of a nozzle array pair arranged in a staggered manner, and a single main scan pass is then performed in response to the referenced printing data, the printing can be performed by using all the nozzles in the nozzle array pair in a single main scan pass. As a result, speeding up of printing can be achieved.

Figures 17A, 17B:
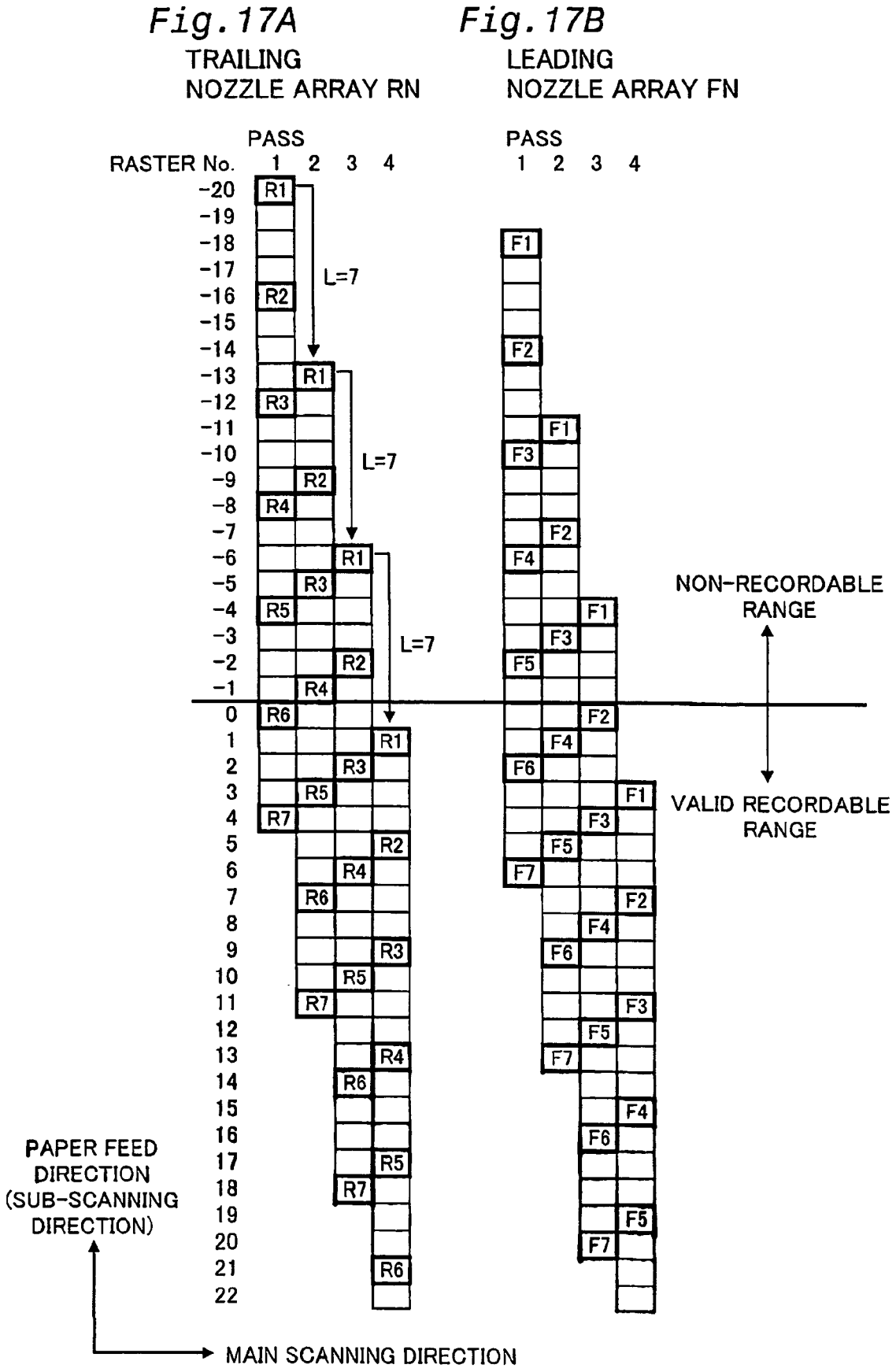
FIGS. 17A and 17B illustrate the recording mode of FIG. 16 for a trailing nozzle array RN and a leading nozzle array FN, respectively.

FIGS. 17A and 17B show the recording mode of FIG. 16 with the trailing nozzle array RN and the leading nozzle array FN, respectively. Since a sub-scan feed with a constant feed amount L is applied to the trailing nozzle array RN, all of the successive main scan lines (raster lines) within a valid recordable range can be recorded with the same ink by the trailing nozzle array RN. This also applies to the leading nozzle array FN. The term "valid recordable range" used herein represents a range where successive main scan lines therein can be recorded by each nozzle array disposed on the print head 28*b*, with no space made therebetween. In the example of FIG. 17B, the leading nozzle array FN cannot perform recording on a main scan line of raster number –1. Accordingly, the valid recordable range is a range below a main scan line of raster number 0. A range not contained in the valid recordable range is referred to as a "non-recordable range". The valid recordable range can also be referred to as "valid printable range", "printing region", or "recording region." FIGS. 17A and 17B illustrate a case where no upper end process (described in later) is performed.

The recording mode of FIGS. 17A and 17B is generally referred to as an "interlace recording mode." The term "interlace recording mode" represents a recording mode where only a plurality of main scan lines spaced one another are recorded by a nozzle array in a single main scan pass, and where recording of successive main scan lines is achieved by plural main scan passes that includes at least one sub-scan feed therebetween.

In the interlace recording mode shown in FIGS. 17A and 17B, sub-scan feed is performed such that each main scan line is not recorded by nozzles of the same nozzle number of the nozzle array pair FN, RN, but each main scan line is recorded with nozzles of different nozzle numbers. Specifically speaking, on the main scan line of raster number 0, the second nozzle F2 in the leading nozzle array FN and the sixth nozzle R6 of the trailing nozzle array RN perform recording. On the main scan line of raster number 1, the fourth nozzle F4 in the leading nozzle array FN and the first nozzle R1 of the trailing nozzle array RN perform recording. Advantages of such recording mode will be apparent in comparison with a second example described below.

Figures 18A, 18B:
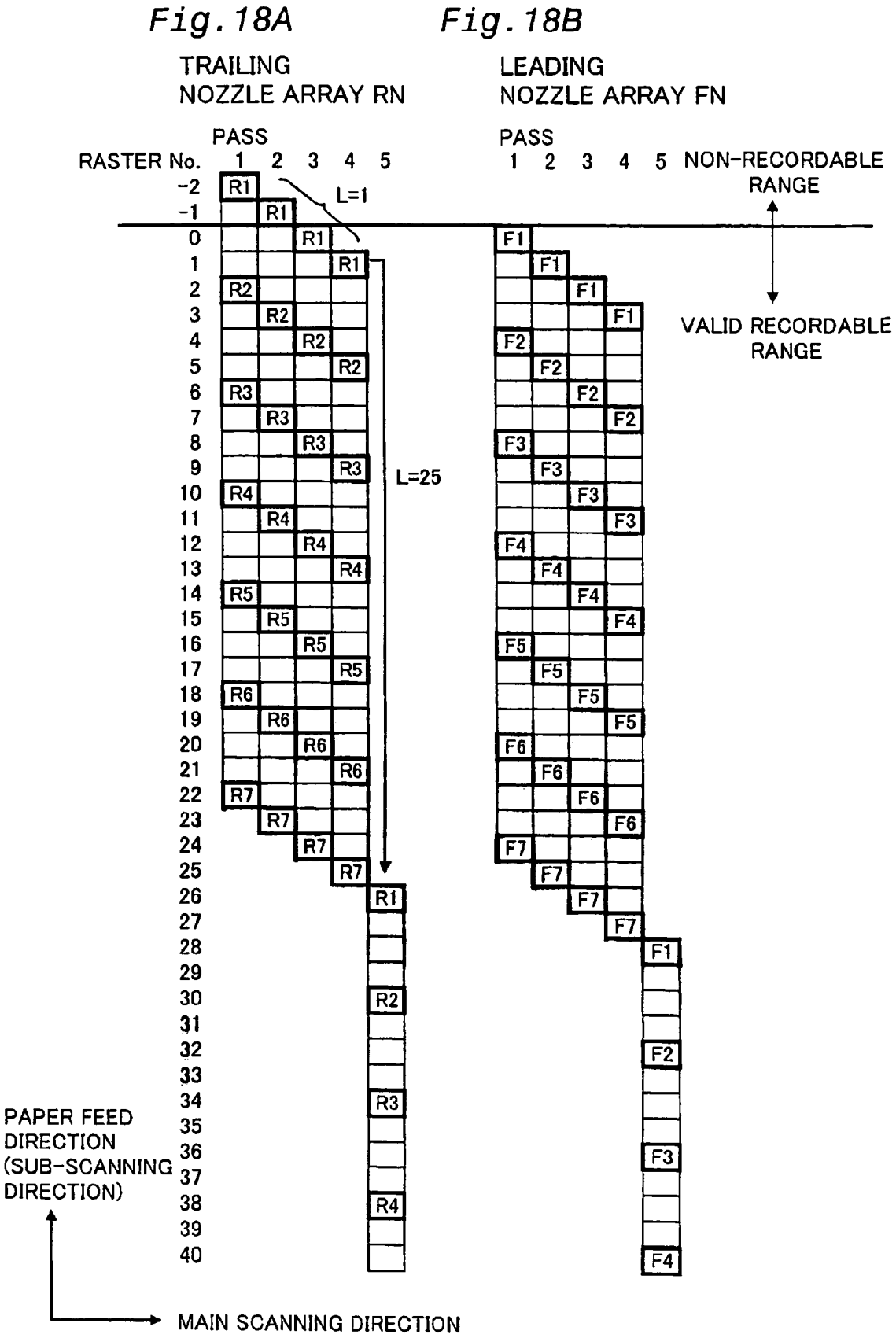
FIGS. 18A and 18B show a second example of the recording mode for midsection.

FIGS. 18A and 18B show a second example of the midsection process. In this recording mode, sub-scan feed is performed by a feed amount L of 1 dot for three times and then by a feed amount L of 25 dots for one time. By repeating the combination of these four sub-scan feeds and four main scans that are performed once for every sub-scan feed, all the successive main scan lines within the valid recordable range can be recorded.

In this second example, two main scan lines of raster number 0 and 1 are recorded by the first nozzle F1 in the leading nozzle array FN and the first nozzle R1 in the trailing nozzle array RN. Two main scan lines of raster number 4 and 5 are recorded by the second nozzle F2 in the leading nozzle array FN and the second nozzle R2 in the trailing nozzle array RN. The recording modes are extremely limited in which the same main scan line is recorded by nozzles of the same nozzle number of the leading nozzle array FN and the trailing nozzle array RN. On the other hand, other than the one shown in FIGS. 17A and 17B, there may be various recording modes that record the same main scan line by nozzles of different nozzle numbers. For example, although the sub-scan feed amount L is a constant value of 7 dots in the first example of FIGS. 17A and 17B, numerous recording modes may be configured by using a combination of different values as the feed amount L. It is accordingly possible to improve image quality by selecting a recording mode that can achieve good image quality, from these numerous recording modes.

In the second example of FIGS. 18A and 18B, four successive main scan lines are recorded by the same nozzle. Here, suppose the ink discharging direction from a nozzle (nozzle R1 for example) is declined from a normal direction because of its manufacturing errors, dots may possibly be formed dislocated on a printing medium. Degradation of image quality will be significant if such dislocation continues over the successive main scan lines. On the contrary, since successive main scan lines are not recorded by the same nozzle in the first example shown in FIGS. 17A and 17B, occurrence of such image quality degradation can be advantageously restrained.

On the other hand, the second example shown in FIGS. 18A and 18B is advantageous in that the non-recordable range can be reduced and the valid recordable range can be broaden compared with the first example.

Figures 19A, 19B:
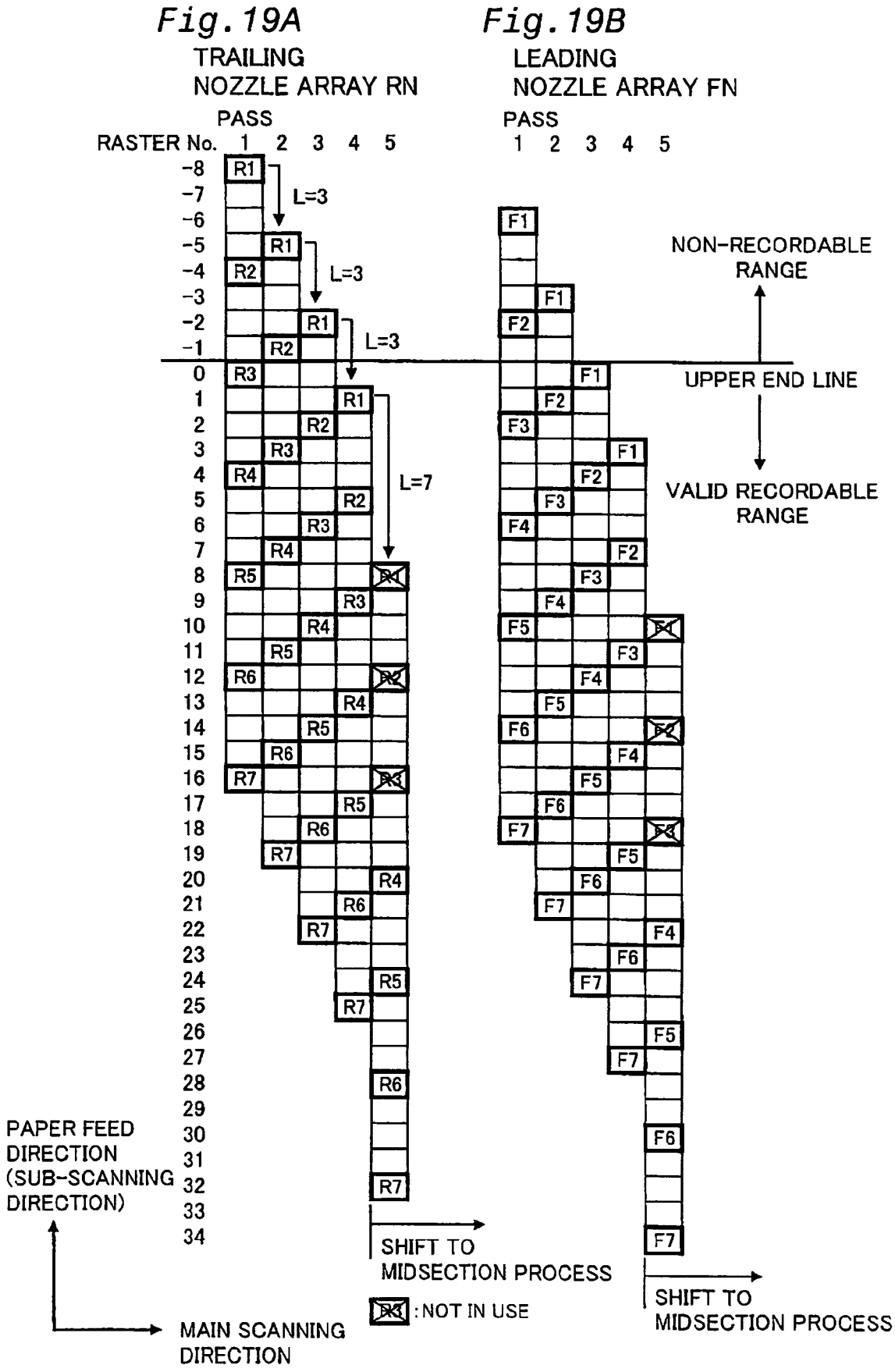
FIGS. 19A and 19B show an example of an upper-end process.

FIGS. 19A and 19B show an example of the upper end process. In this example, four main scan passes from pass 1 to pass 4 belong to upper end process, and passes from the fifth pass belong to midsection process. The sub-scan feed amount L of the upper end process is a constant value of 3 dots. The mark X superscripted over each nozzle number indicates that the nozzle is not used in the corresponding pass.

If the recording mode for the midsection process shown in FIGS. 17A and 17B is applied from a leading edge of a printing paper, a non-recordable region corresponding to 20 main scan lines exists on an upper side of a valid recordable range, as shown in FIG. 17A. On the other hand, the non-recordable range is reduced to 8 main scan lines in the example of FIG. 19A. In this way, the valid recordable range can be broaden by performing an upper-end process that has a feed amount L smaller than that in the recording mode for a midsection process.

In FIGS. 19A and 19B, it is understood that an upper-end line of the valid recordable range is the first one of consecutive main scan lines that are fully recordable by the leading nozzle array FN. That is, the CPU 41 determines the upper-end line of the valid recordable range according to a range in the sub-scanning direction that is recordable by the leading nozzle array FN. In other words, in an upper-end process, the sub-scan feed amount and the number of main scan passes may be determined such that the leading nozzle array FN can record main scan lines as close to the upper end of paper as possible. In this way, it would be easy to determine a leading edge of the valid recordable region proximate to a leading edge of a printing medium while reducing the number of excess main scan passes as much as possible.

Figures 20A, 20B:
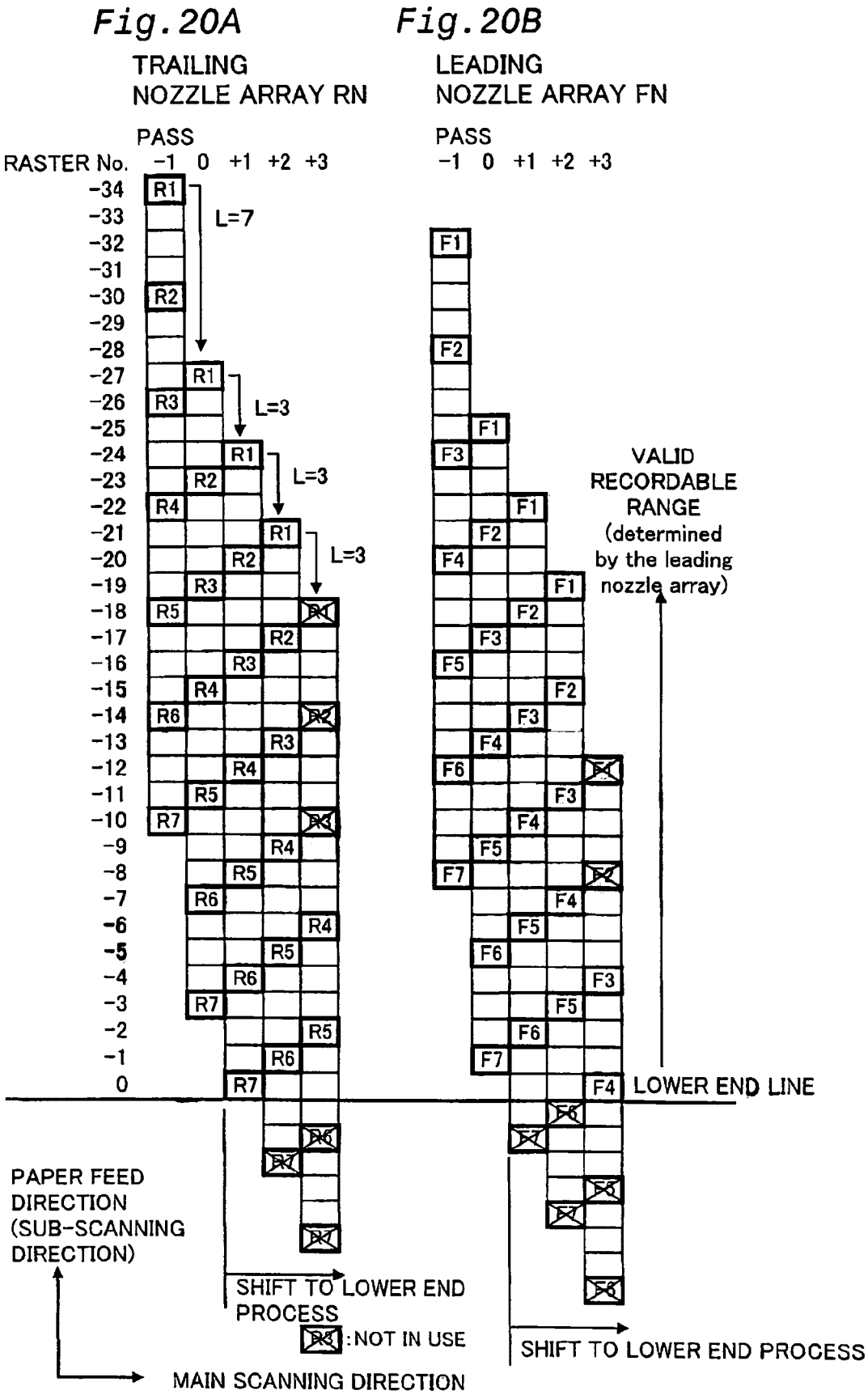
FIGS. 20A and 20B show an example of a lower-end process.

FIGS. 20A and 20B show an example of the lower end process. In this example, two passes of pass −1 and pass 0 belong to the midsection process and three passes from pass+1 to pass+3 belong to the lower-end process. The sub-scan feed amount L of the lower end process is a constant value of 3 dots.

When the process shifts from the midsection process to the lower-end process, the CPU 41 determines whether or not the leading edge nozzle F7 of the leading nozzle array FN excesses expected lower-end line of the valid recordable range, on the assumption that sub-scan feed (L=7) is performed according to the recording mode midsection process. When it is determined that the leading edge nozzle F7 exceeds the expected lower-end line of the valid recordable range, the process then shifts to the lower-end process. In the example of FIGS. 20A and 20B, if sub-scan feed is performed with a feed amount of 7 dots after the pass 0, the leading edge nozzle F7 of the leading nozzle FN exceeds the expected lower-end line. In this case, the valid recordable range can be broaden by performing a lower-end process with a smaller feed amount L, rather than continuing the midsection process. Accordingly, the CPU 41 sets the sub-scan feed amount L before the pass+1 to 3 dots, and then shifts to the lower-end process. In this way, the process can be shifted to the lower-end process, while reducing the number of excess main scan passes as much as possible.

The valid recordable range is broaden by the lower-end process of FIGS. 20A and 20B, as well as by the upper-end process shown in FIGS. 19A and 19B. Furthermore, the lower-end line of the valid recordable range is determined according to an area in which consecutive main scan lines are recordable by the trailing nozzle array RN. That is, the CPU 41 determines the lower-end line of the valid recordable range according to a range of the sub-scanning direction that is fully recordable by the trailing nozzle array RN. In this way, it would be easy to determine a trailing edge of a valid recordable region proximate to a trailing edge of a printing medium too, while reducing the number of excess main scans as much as possible.

E. Modifications

E1. Modification 1

As for nozzle arrays of print head, various arrangements other than the embodiments described above are possible. For example, it is possible to form a print head that is longer in sub-scanning direction and thinner in main scanning direction, by arranging all or a part of the nozzle array pairs in the staggered arrangements along the sub-scanning direction.

Inks other than light cyan and light magenta are also adoptable as light inks. If three or more light ink nozzle arrays exist, it is preferable that at least two of them are arranged to have the same positional relationship as that of a zigzag nozzle array pair with respect to at least positions in the sub-scanning direction.

E2. Modification 2

Although each of the above embodiments are described with respect to ink jet printers, the present invention is not restricted to ink jet printers but is generally applicable to various printing devices that performs printing with a print head. Furthermore, the present invention is not restricted to methods or devices that discharge ink droplets, but is also applicable to methods or devices that record dots with other means.

E3. Modification 3

Although sub-scan feed of a constant feed amount L ("constant feeding") has been employed in the midsection process in the above embodiments, it is also possible to employ sub-scan feeding that uses a plurality of different feed amounts ("anomalous feeding"). The anomalous feeding can also be employed in the upper-end process or the lower-end process. In these cases, the average of the sub-scan feed amount in the upper-end process is set to be smaller than the average of the sub-scan feed amount in the midsection process. This also applies to the lower-end process. The term "small sub-scan feed amount" has a broad meaning including these cases.

E4. Modification 4

In the above embodiments, a single nozzle is capable of recording all pixels on a single main scan line in a single main scan pass. However, the present invention can also be applied to other recording modes where only some of the pixels on a single main scan line can be intermittently recorded by a single nozzle in a single main scan pass. In such recording modes, a plurality of nozzles is used to record all pixels on a single main scan line in a plurality of main scans.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing method comprising the steps of:

providing a print head having a plurality of nozzle arrays, each of the nozzle arrays having a plurality of nozzles arranged along a sub-scanning direction for discharging a same ink, at least one pair of nozzle arrays for discharging different inks being positioned such that nozzles of the nozzle array pair are arranged in a staggered manner, the staggered nozzle array pair consists of a leading nozzle array that reaches a leading edge of the printing medium relatively earlier and a trailing nozzle array that reaches the leading edge relatively later when the sub-scan is performed;

(a) performing interlace recording where only a plurality of main scan lines separated one another are recorded by each nozzle array in a single main scan pass, and where recording of successive main scan lines is achieved by a plurality of main scan passes that include at least one sub-scan feed therebetween; and (b) in the interlace recording, referring to the printing data memory prior to a main scan pass, for printing data of a plurality of main scan lines that correspond to an overall width in the sub-scanning direction of the staggered nozzle array pair, and performing the main scan pass according to the referenced printing data wherein the step (a) comprises the step of:

(c) performing sub-scan feed such that a same main scan line is not recorded by two nozzles having a same ordinal nozzle number in the staggered nozzle array pair, but the same main scan line is recorded by two nozzles haying different ordinal nozzle numbers in the staggered nozzle array pair.

2. A printing method according to claim 1, wherein the staggered nozzle array pair is connected to a pair of ink passages for supplying inks to the nozzle array pair, and wherein the pair of ink passages is disposed inside of a same ink passage structure.

3. A printing method according to claim 2, wherein the pair of ink passages have passage portions proximate to respective nozzles that protrude toward an opposite ink passage.

4. A printing method according to claim 1, wherein at least a half of the plurality of nozzle arrays are configured to make a nozzle array pair arranged in a staggered manner.

5. A printing method according to claim 1, wherein the plurality of nozzle arrays includes four basic color nozzle arrays for discharging basic color inks of four colors of black, cyan, magenta, and yellow, respectively; and wherein the four basic color nozzle arrays are arranged in same positions with respect to the sub-scanning direction.

6. A printing method comprising the steps of:

providing a print head having a plurality of nozzle arrays, each of the nozzle arrays having a plurality of nozzles arranged along a sub-scanning direction for discharging a same ink, at least one pair of nozzle arrays for discharging different inks being positioned such that nozzles of the nozzle array pair are arranged in a staggered manner, the staggered nozzle array pair consists of a leading nozzle array that reaches a leading edge of the printing medium relatively earlier and a trailing nozzle array that reaches the leading edge relatively later when the sub-scan is performed;

(a) performing interlace recording where only a plurality of main scan lines separated one another are recorded by each nozzle array in a single main scan pass, and where recording of successive main scan lines is achieved by a plurality of main scan passes that include at least one sub-scan feed therebetween; and (b) in the interlace recording, referring to the printing data memory prior to a main scan pass, for printing data of a plurality of main scan lines that correspond to an overall width in the sub-scanning direction of the staggered nozzle array pair, and performing the main scan pass according to the referenced printing data, wherein the step (a) further comprises the steps of:

(d) performing the interlace recording according to a first recording mode in a midsection of a recording region on the printing medium, and performing printing according a second recording mode proximate to a leading edge of the recording region, the second recording mode using a sub-scan feed amount smaller than that of the first recording mode; and (e) in the printing proximate to the leading edge of the printing medium by the second recording mode, determining a leading edge of the recording region according to a range in the sub-scanning direction that is fully recordable by the leading nozzle array.

7. A printing method according to claim 6, wherein the step (a) further comprises the steps of:

(f) perfomiing the interlace recording according to a third recording mode proximate to a trailing edge of the printing medium, the third recording mode using a sub-scan feed amount smaller than that of the first recording mode applied to the midsection; and (g) in the printing proximate to the trailing edge of the printing medium by the third recording mode, determining a trading edge of the recording region according to a range in the sub-scanning direction that is fully recordable by the trailing nozzle array.

8. A printing method according to claim 7, wherein the step (a) further comprises the step of:

(h) during printing according the second recording mode, if an end nozzle at a leading edge of the leading nozzle array will exceed an expected trailing edge of the recording region due to a sub-scan feed according to the second recording mode, changing from the second recording mode to the third recording mode prior to the sub-scan feed.

9. A printing method according to claim 6, wherein the staggered nozzle array pair is connected to a pair of ink passages for supplying inks to the nozzle array pair, and wherein the pair of ink passages is disposed inside of a same ink passage structure.

10. A printing method according to claim 9, wherein the pair of ink passages have passage portions proximate to respective nozzles that protrude toward an opposite ink passage.

11. A printing method according to claim 6, wherein at least a half of the plurality of nozzle arrays are configured to make a nozzle array pair arranged in a staggered manner.

12. A printing method according to claim 6, wherein the plurality of nozzle arrays includes four basic color nozzle arrays for discharging basic color inks of four colors of black, cyan, magenta, and yellow, respectively; and wherein the four basic color nozzle arrays are arranged in same positions with respect to the sub-scanning direction.

* * * * *

UNITED STATES PATENT AND TRADEMARK OFFICE

CERTIFICATE OF CORRECTION

PATENT NO. : 7,048,357 B2
APPLICATION NO. : 11/084437
DATED : May 23, 2006
INVENTOR(S) : Akito Sato It is certified that error appears in the above-identified patent and that said Letters Patent is hereby corrected as shown below:

In line 30 of claim 1 (column 14, line 23) change “haying” to --having--.

In line 3 of claim 7 (column 15, line 16) change “perfomiing” to --performing--.

In line 10 of claim 7 (column 15, line 23) change “trading edge” to --trailing edge--.

Signed and Sealed this

Seventeenth Day of April, 2007

JON W. DUDAS
*Director of the United States Patent and Trademark Office*